US007669721B2

(12) United States Patent
Kemper et al.

(10) Patent No.: US 7,669,721 B2
(45) Date of Patent: Mar. 2, 2010

(54) DRYING RACK ASSEMBLY FOR BABY BOTTLES

(75) Inventors: Bernard J. Kemper, Bonne Terre, MO (US); David E. Hays, Bonne Terre, MO (US)

(73) Assignee: Handi-Craft Company, St. Louis, MO (US)

( * ) Notice: Subject to any disclaimer, the term of this patent is extended or adjusted under 35 U.S.C. 154(b) by 170 days.

(21) Appl. No.: 11/564,631

(22) Filed: Nov. 29, 2006

(65) Prior Publication Data

US 2007/0125725 A1 Jun. 7, 2007

Related U.S. Application Data

(60) Provisional application No. 60/741,193, filed on Dec. 1, 2005.

(51) Int. Cl.
*A47G 19/08* (2006.01)

(52) U.S. Cl. ..... 211/41.3; 211/126.1

(58) Field of Classification Search ..... 211/41.8, 211/41.9, 85.18, 74, 126.12, 126.1, 126.16, 211/126.2, 41.3; D32/3, 6, 25, 55; 4/646; 68/152–156; 220/487, 488, 572; 108/55.1, 108/57.13

See application file for complete search history.

(56) References Cited

U.S. PATENT DOCUMENTS 4,527,707 A * 7/1985 Heymann et al. ..... 220/571
4,621,739 A * 11/1986 Heymann et al. ..... 211/74
5,078,282 A * 1/1992 Stanfield ..... 211/74
5,109,990 A * 5/1992 Murphy et al. ..... 211/41.3
5,119,943 A * 6/1992 Hoang ..... 211/41.3
5,385,261 A * 1/1995 Lippisch et al. ..... 220/572
5,605,236 A * 2/1997 Welch ..... 211/41.8
5,779,071 A 7/1998 Brown et al.
5,943,786 A * 8/1999 Stahley ..... 34/106
6,125,548 A * 10/2000 Dunn et al. ..... 34/104
6,443,316 B1 * 9/2002 Mao ..... 211/74
D490,198 S * 5/2004 Jerstroem et al. ..... D32/55
7,036,270 B1 * 5/2006 Shepherd ..... 47/18
7,325,693 B2 * 2/2008 Burns et al. ..... 206/710
2001/0040141 A1 * 11/2001 Martorella et al. ..... 211/41.6
2002/0179551 A1 * 12/2002 Madela ..... 211/41.3
2005/0016941 A1 * 1/2005 Neff et al. ..... 211/41.9
2006/0169652 A1 * 8/2006 Yang et al. ..... 211/41.3
2007/0090063 A1 * 4/2007 Schmidt ..... 211/41.3

* cited by examiner

*Primary Examiner*—Jennifer E. Novosad
(74) *Attorney, Agent, or Firm*—Armstrong Teasdale LLP

(57) ABSTRACT

A drying rack assembly for drying baby bottle components features a drying rack and a drip pan which supports the drying rack. The drying rack suitably is porous, with tubular support posts extending upwardly from a support surface thereof, and the drip pan suitably has a draining configuration in which liquid caught by the drip pan drains out of the drip pan and a collecting configuration in which liquid caught by the drip pan remains within the drip pan. The drying rack assembly is suitably configured such that multiple such drying rack assemblies can be stacked on top of each other in a drying rack system. In another configuration, the drying rack is of one-piece construction, with a plurality of support posts and a plurality of longer stacking posts extending from a support surface of the drying rack. The one-piece configuration is designed for stacking of multiple such drying racks.

16 Claims, 33 Drawing Sheets

DRYING RACK ASSEMBLY FOR BABY BOTTLES

CROSS-REFERENCE TO RELATED APPLICATION

The invention of the present application is related to and claims priority to provisional U.S. patent application Ser. No. 60/741,193, entitled DRYING RACK ASSEMBLY FOR BABY BOTTLES, filed on Dec. 1, 2005, the entire disclosure of which is incorporated herein by reference.

BACKGROUND

The present invention relates generally to a drying rack assembly, and more particularly, to a drying rack assembly for use in air-drying baby bottles.

Baby bottles are typically constructed of multiple components, including the bottle, the nipple, the collar that secures the nipple on the bottle, and a cap for covering the nipple when the bottle is not in use. Some baby bottles, such as the bottles available from Handi-Craft Company of St. Louis, Mo., U.S.A. under the tradename Dr. Brown's Natural Flow and described in U.S. Pat. No. 5,779,071, have additional components to inhibit vacuum from forming in the bottle and to inhibit air bubbles from forming in the milk or formula in the bottle during use.

While some or all of the baby bottle components are now made to be dishwasher safe, it is still common for caregivers to hand wash the bottles and their associated components. The hand washed bottles and components are typically then strewn over the kitchen counter-tops for air-drying, using up a great deal of counter space. When air-drying in this manner water may pool around the bottle and associated components (e.g., where the components seat against the counter-top surface), thereby facilitating bacterial growth on the bottle components. Alternatively, the hand washed bottles and components may be placed in conventional drying racks that sit next to the sink. However, these drying racks are more aptly designed to hold plates, bowls, pans, glasses and other kitchenware and do not conveniently hold baby bottle components.

There is a need, therefore, for an improved drying rack assembly for air drying baby bottles (i.e., the bottle itself and the various component parts and accessories associated therewith).

SUMMARY

In one embodiment, a drying rack assembly for use in air-drying baby bottle components after washing generally comprises a drying rack having a support surface for supporting one or more baby bottle components. The support surface is porous to permit liquid that drains from the bottle components to pass through the support surface. A drip pan is constructed to at least in part support the drying rack above the drip pan to catch liquid that passes through the support surface. The drip pan is configurable between a draining configuration in which liquid caught by the drip pan drains out of the drip pan and a collecting configuration in which liquid caught by the drip pan remains within the drip pan.

In another embodiment, a drying rack system for use in air-drying baby bottle components after washing generally comprises a first drying rack assembly comprised at least in part of a support surface for supporting one or more baby bottle components during air-drying. A second drying rack assembly is separate from the first drying rack assembly and comprises at least in part a support surface for supporting one or more baby bottle components during air-drying. The first and second drying rack assemblies are stackable, one on top of the other, with the support surface of the second drying rack assembly in spaced relationship with the first drying rack assembly during air-drying.

BRIEF DESCRIPTION OF THE DRAWINGS

Corresponding reference characters indicate corresponding parts throughout the drawings.

DETAILED DESCRIPTION

Figure 1:
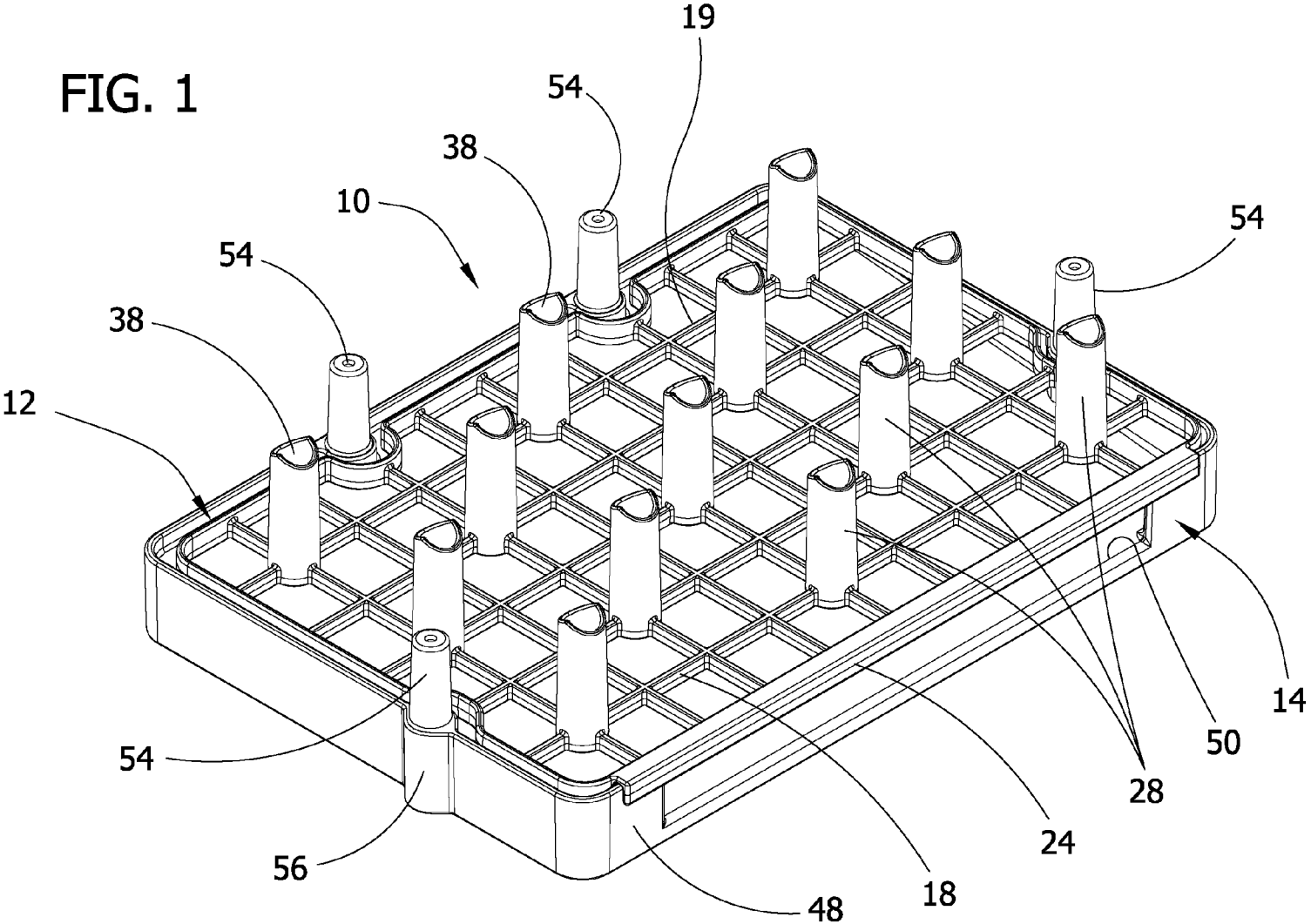
FIG. 1 is a perspective view of one embodiment of a drying rack assembly including a drying rack and drip pan.

Referring now to the drawings, and in particular to FIGS. 1-18, one embodiment of a drying rack assembly for use in drying baby bottles is generally indicated at 10. The drying rack assembly 10 generally comprises a porous drying rack, generally indicated at 12, for supporting the various components of the baby bottles while allowing liquid (e.g., water) that drains off of the various bottle components to pass through the drying rack, and a drip pan, generally indicated at 14, for collecting liquid (e.g., water) that drains through the drying rack.

Drying Rack

With particular reference to FIGS. 1-6, the drying rack 12 is illustrated as being generally rectangular but having rounded corners. As an example, the drying rack 12 may suitably have a length in the range of about 9.0 in (22.9 cm) to about 15.0 in (38.1 cm), and a width in the range of about 6.5 in (16.5 cm) to about 10.5 in (26.7 cm). It is understood, however, that the drying rack 12 may be other than rectangular (e.g., square, circular or other suitable shape) and may be dimensioned larger or smaller than as set forth above without departing from the scope of this invention.

Figure 2:
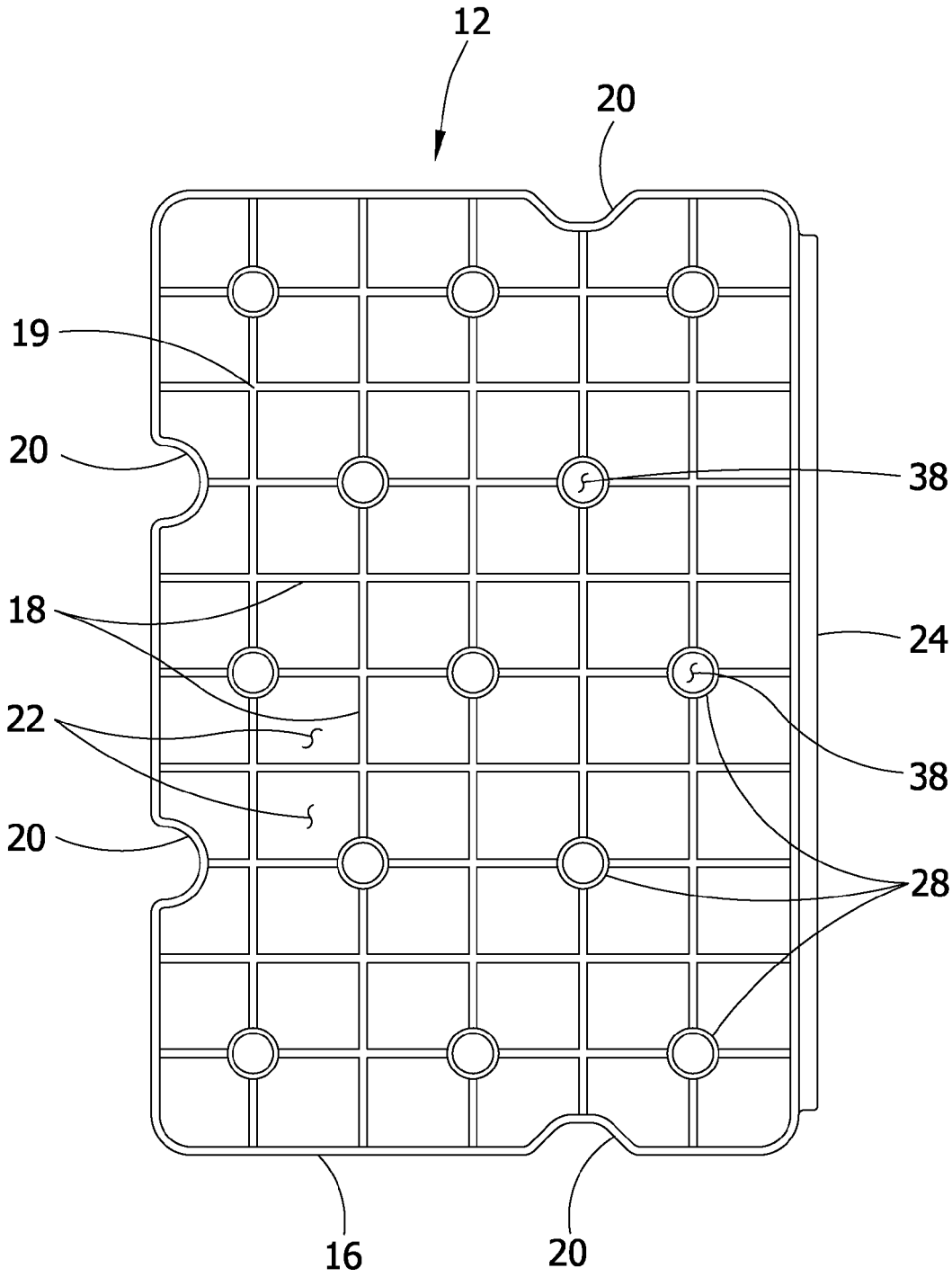
FIG. 2 is a top plan view of the drying rack of FIG. 1, the drip pan being omitted.

For reference purposes in describing the drying rack 12, the side of the drying rack extending generally horizontally across the foreground of FIG. 1 and extending vertically up the right hand side of the drying rack in FIG. 2 will be referred to herein as the front of the drying rack. The opposite side of the drying rack 12 will thus be referred to as the back of the drying rack. The sides of the drying rack 12 that extend from the front to the back of the drying rack will be referred to as the left and right sides of the drying rack.

The drying rack 12 illustrated in FIGS. 1 and 2 comprises a peripheral side wall 16 defining the peripheral extent of the drying rack, and a pattern of crossed support members 18 supported by the peripheral side wall and broadly defining a support surface on which bottle components may be placed for air-drying. As best illustrated in FIG. 2, the side wall 16 has a recessed portion 20 recessed inward of the drying rack 12 at each of the left and right hand sides thereof and a pair of recessed portions recessed inward of the drying rack and spaced apart from each other at the back of the drying rack.

With particular reference to FIG. 2, a first set of support members 18 extend from the front to the back of the drying rack 12 in parallel, spaced relationship with each other, and another set of support members extend from the left side to the right side of the drying rack in parallel spaced relationship with each other and generally orthogonal to the first set of support members. The first set of support members 18 intersect and are interconnected with the second set of support members to define a support surface 19 having a plurality of openings 22 in the drying rack 12 through which liquid drained from the bottle components supported by the drying rack support surface through the support surface to the drip pan. In this manner, the support surface has a generally grate or mesh pattern.

As an example, in the illustrated embodiment the drying rack 12 has nine front-to-back extending support members 18 and five side-to-side extending support members. The spacing between the front-to-back extending support members 18 is slightly different from the spacing between the side-to-side extending support members so that the openings 22 formed in the support surface 19 are not precisely square. As an example, the spacing between the front-to-back extending support members 18 of the illustrated embodiment is about 1.125 inches (about 2.86 cm) and the spacing between the side-to-side extending support members is approximately 1.25 inches (about 3.18 cm). Is understood, though, that the spacing between the front-to-back extending support members 18 may be equal to the spacing between the side-to-side extending support members such that the openings 22 formed in the support surface are generally square without departing from the scope of this invention. However, the openings 22 in the support surface 19 of the drying rack 12 are suitably small in size to inhibit the various bottle components against falling through the openings into the drip pan 14. It is further understood that the number of front-to-back extending support members 18 and/or the number of side-to-side extending support members may be other than as set forth above and illustrated in the drawings.

The cross-sectional dimensions of the front-to-back extending support members 18 are suitably the same as the cross-sectional dimensions of the side-to-side extending support members. However, it is understood that the cross-sectional dimensions of the front-to-back extending support members 18 may be different from the cross-sectional dimensions of the side-to-side extending support members and remain within the scope of this invention. It is also contemplated that the front-to-back extending support members 18 need not each have the same cross-sectional dimensions and/or the side-to-side extending support members need not each have the same cross-sectional dimensions.

The support members 18 of the illustrated embodiment are suitably formed integrally with each other, e.g., where they cross and are interconnected with each other, and are also suitably formed integrally with the peripheral side wall 16 of the drying rack 12. It is understood, though, that the support surface 19 defined by the support members may be formed separate from the peripheral side wall 16 and supported by the side wall, such as by suitable shoulders (not shown) formed in the side wall, without departing from the scope of this invention. It is also understood that the support surface 19 may be formed other than by interconnected support members 18. For example, the support surface 19 may be defined by a panel (not shown) having any shaped openings formed or bored therethrough to permit liquid drained from bottle components supported by the support surface to drain through to the drip pan 14.

As seen best in FIG. 1, the support members 18 defining the support surface 19 of the drying rack 12 are set slightly below the peripheral side wall 16 of the drying rack such that the side wall inhibits bottle components resting on the support surface against sliding off of the drying rack. It is alternatively contemplated that the support members 18 of the drying rack support surface 19 may be set generally at the bottom of the peripheral side wall 16. It is also contemplated that the cross-sectional shape of each of the support members 18 may be configured to facilitate dripping of water down over the support members and into the drip pan 14. For example, the cross-sectional shape of each support member 18 may be such that the width of the support member tapers inward or otherwise decreases toward the underside of the support member (e.g., facing the drip pan 14), such as egg-shaped, triangular, frustoconical, trapezoidal and the like. Alternatively, or additionally, the cross-sectional shape of each of the support members 18 may facilitate the removal of water from the bottle components supported by the support members, such as by tapering the width of the support member inward toward the top of the support member (e.g., toward the support surface 19).

An elongate, generally L-shaped (inverted) flange 24 (FIGS. 1, 2 and 4) is connected to the peripheral side wall 16 of the drying rack 12 along the front of the drying rack for use in seating the drying rack on the drip pan 14 as will be described in further detail later herein. In particular, the flange 24 projects outward from the peripheral side wall 16 to define a channel 26 (FIG. 4) between the flange and the side wall at the front of the drying rack 12. The flange 24 may suitably be formed integrally with the side wall 16, such as by molding, or it may be formed separate from the side wall of the drying rack 12. It is also understood that the flange 24 may be omitted and the drying rack 12 may be seated on the drip pan 14 in another suitable manner without departing from the scope of this invention.

Figure 3:
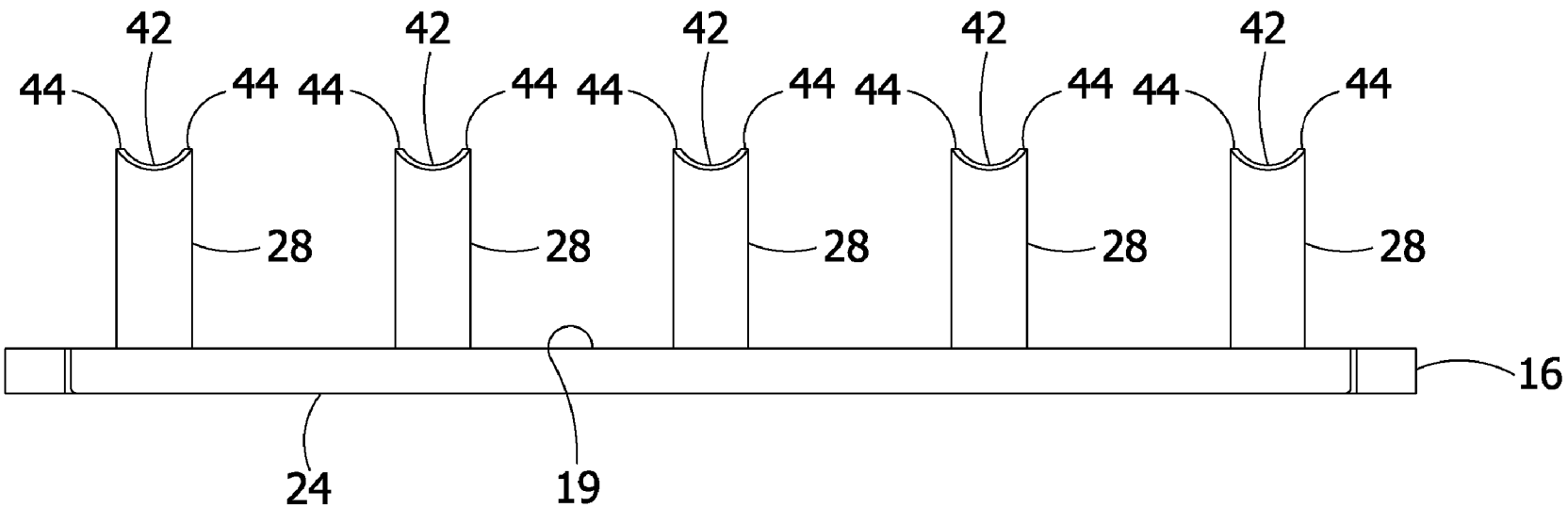
FIG. 3 is a front elevation thereof.
Figure 4:
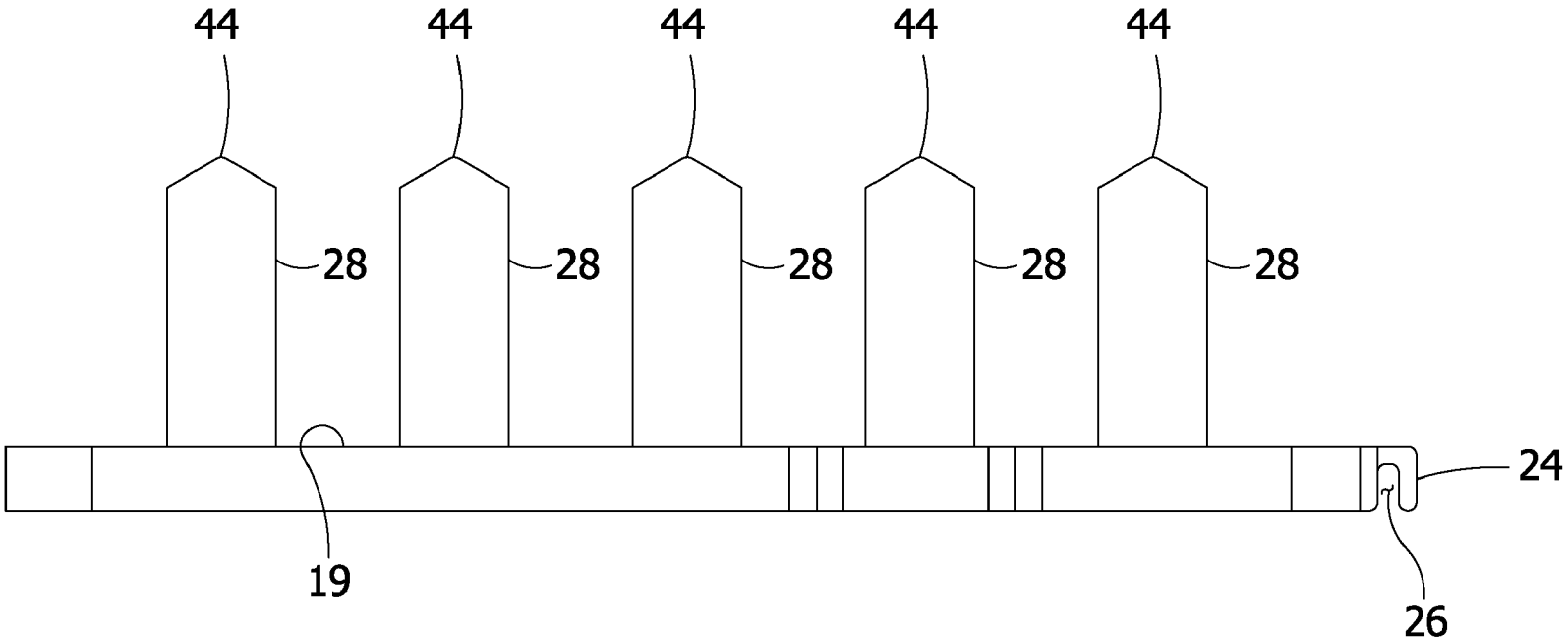
FIG. 4 is a side elevation thereof.
Figure 5:
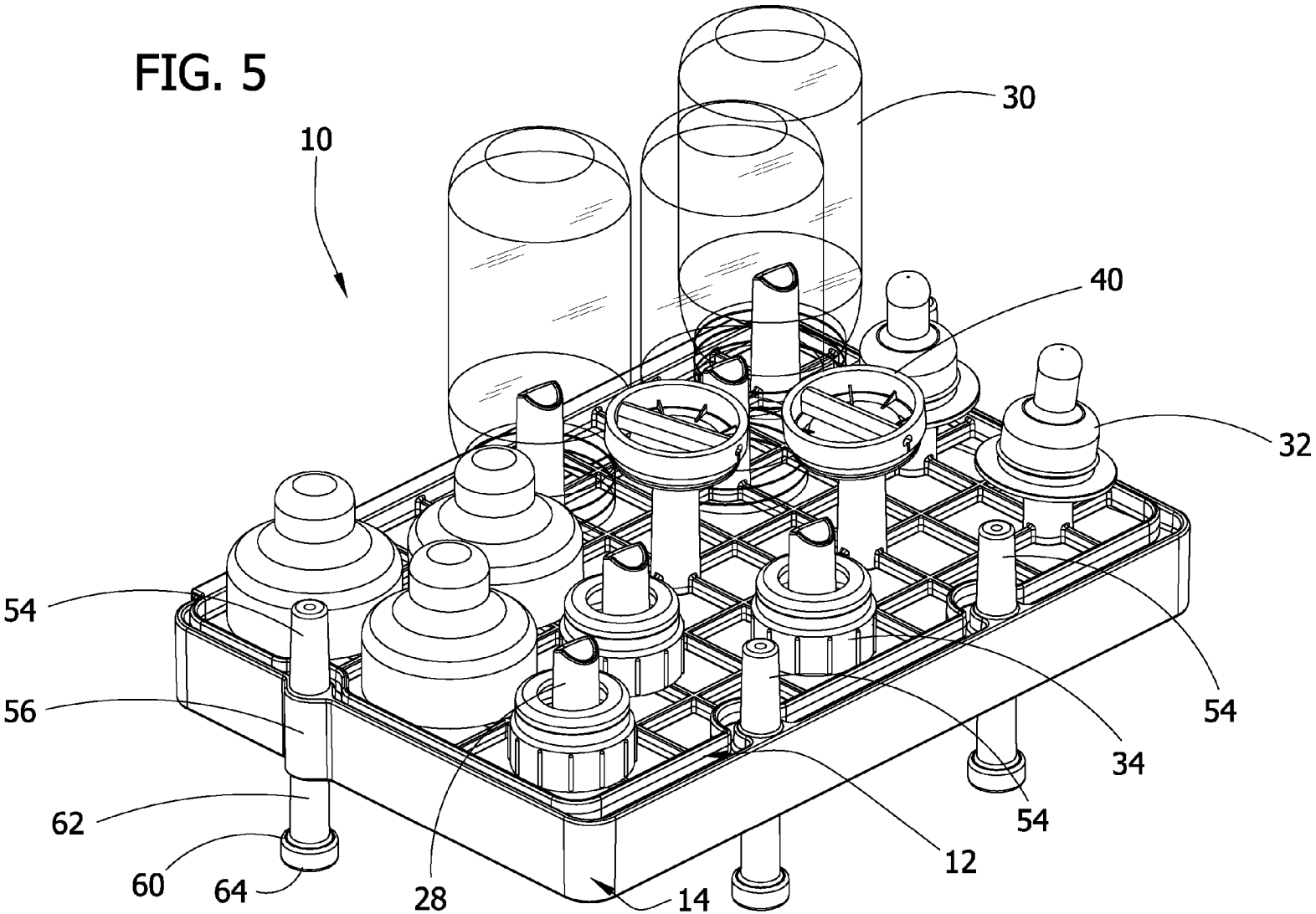
FIG. 5 is a perspective view of the drying rack assembly of FIG. 1 shown supported above a surface and having multiple baby bottle components drying on the drying rack of the assembly.
Figure 6:
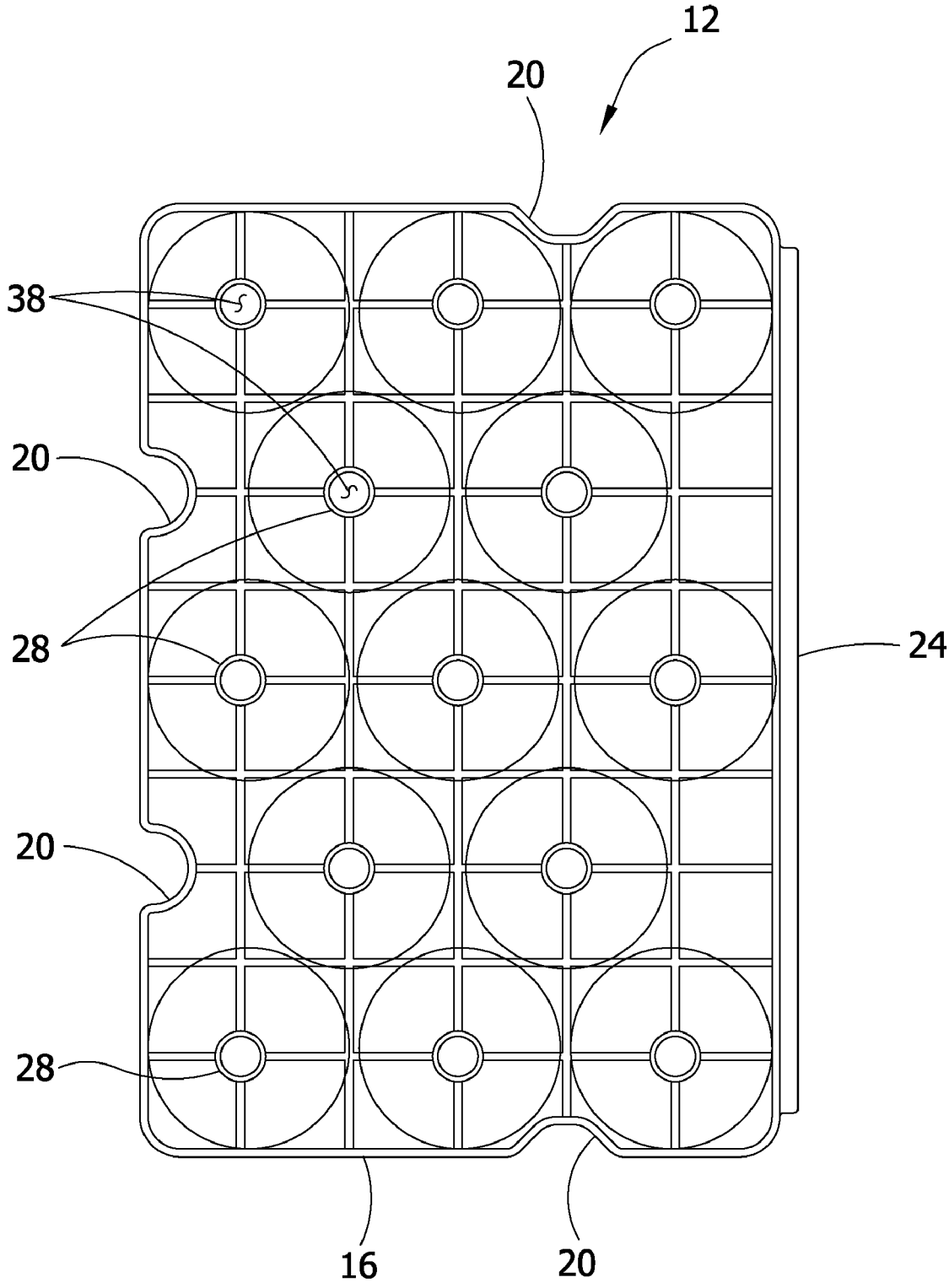
FIG. 6 is a top plan view of the drying rack, similar to FIG. 2, with baby bottles supported by the drying rack.

Referring to FIGS. 1-5, the drying rack 12 further comprises support posts 28 that extend up from the support surface 19 for holding and/or locating for placement various baby bottle components. In the illustrated embodiment the support posts 28 are suitably tubular. As an example of how the support posts 28 are used, the support posts may be received in the tops of respective baby bottles 30 (such that the bottle is positioned upside down) as shown in FIG. 5 to positively locate the bottles on the support surface 19, and in some instances (depending on the size of the bottle opening) to inhibit the bottle against falling over while it is drying, or each support post may hold, for example, the nipple 32 of the bottle, the cap 34 of the bottle, or other components above the support surface of the drying rack 12.

Figure 11:
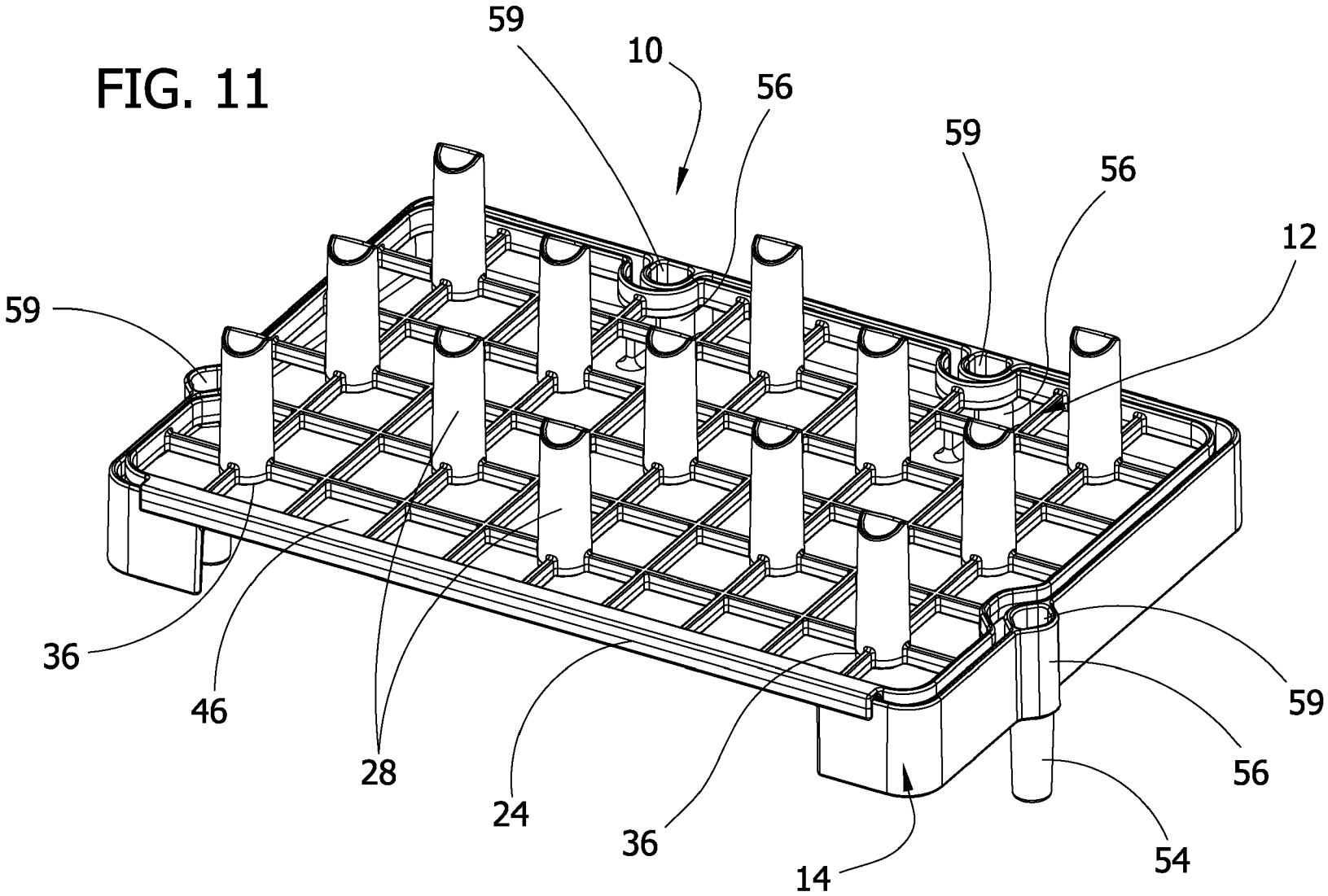
FIG. 11 is a perspective view of the drying rack assembly supported above a surface with the drip pan in a collecting configuration.
Figure 13:
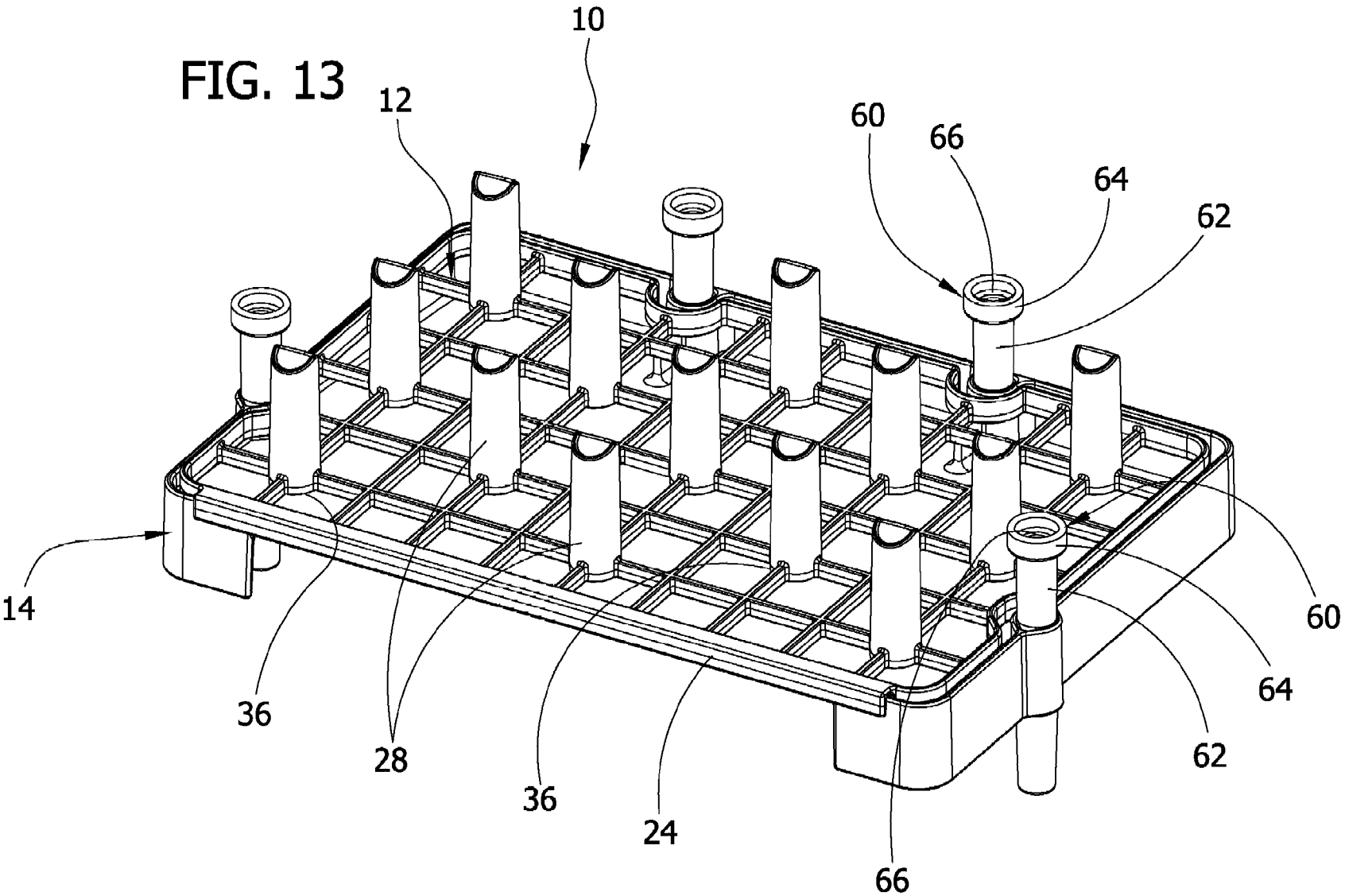
FIG. 13 is a perspective view of the drying rack similar to FIG. 11 with leg extensions also inserted into the drip pan.
Figure 14:
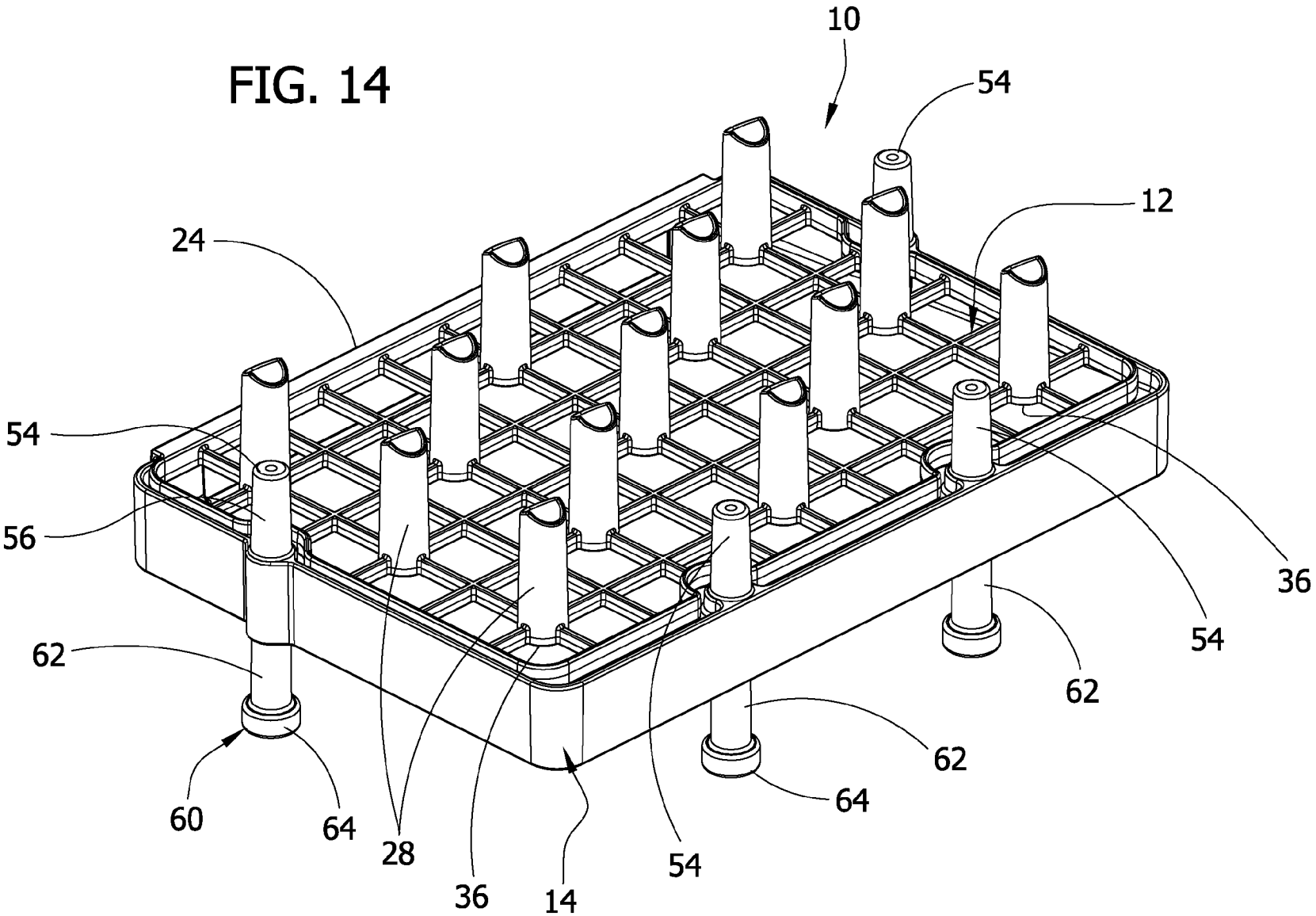
FIG. 14 is a perspective view of the drying rack assembly of FIG. 13 with the drip pan in its draining configuration and the drying rack assembly supported above a surface by the leg extensions.

The support posts 28 of the illustrated embodiment are suitably positioned at the intersections of the support members 18 that define the support surface 19 of the drying rack 12. In particular, as best illustrated in FIGS. 11, 13 and 14 tabbed portions 36 of each support members further extend down along the support members at the intersection therebetween. The support posts 28 of the illustrated drying rack 12 are sufficiently spaced from each other to allow various bottle components, and more suitably the largest bottle component to be dried, to seat directly on the support surface 19 of the drying rack between the support posts. For example, the support posts 28 may be spaced from each other a distance in the range of about 2.0 in. (5.1 cm) to about 4.0 in. (10.2 cm). It is understood, however, that the support posts 28 may be more closely or distally spaced from each other without departing from the scope of this invention. It is also understood that the spacing between adjacent posts need not be uniform among all of the support posts 28. It is further understood that the support posts 28 may be located other than at the intersections between support members 18 without departing from the scope of this invention.

Each support post 28 is open at both its upper end and its lower end and has a central passage 38 extending therethrough (FIGS. 1 and 2). This permits liquid that drains from baby bottle components into the opening at the upper end of the support post 28 to flow down through the central passage 38 and out of the open lower end of the support post into the drip pan 14 below the drying rack 12. The support posts 28 may also be tapered/configured similar to the support members 18 to facilitate water removal from the bottle components. As an example, in one embodiment each support post 28 may suitably have an outer diameter in the range of about 0.5 in. (1.27 cm) to about 1 in. (2.54 cm), and more suitably about 0.65 in. (1.65 cm) and an inner diameter defining the central passage 38 in the range of about 0.25 in. (0.64 cm) to about 0.75 in. (1.91 cm) and more suitably about 0.50 in. (1.27 cm). In a particularly suitable embodiment, the inner diameter is sized and shaped to loosely but stably receive the vent insert 40 (FIG. 5) of a Dr. Brown's Natural Flow baby bottle, available from Handi-Craft Company of St. Louis, Mo., U.S.A.

With reference to FIGS. 3 and 4, the upper end of each support post 28 has an arcuate notch 42 to form a pair of opposed peaks at the upper end of the support post. When a bottle component rests on the upper end of the support post 28, it rests only on the peaks 44 and is otherwise spaced from the upper end of the support post to minimize contact between the bottle component and the support post. The notch 42 allows air to enter the open upper end of the support post 28 while the bottle component rests on the peaks 44 of the support post to facilitate faster drying of the bottle component.

As used herein, a height of each support post 28 is defined as the distance from the support surface of the drying rack 12 to the highest extent of the peaks 44 at the upper end of the support post. In the illustrated embodiment, the heights of the support posts 28 are suitably uniform. As an example, the support posts 28 may each have a height of at least about 1 inch (2.54 cm), more suitably in the range of about 1 inch (2.54 cm) to about 4 in. (10.2 cm), and even more suitably about 1.80 in. (4.57 cm). In a particularly suitable embodiment, the height of each support post 28 is at least greater than the diameter of a baby bottle (i.e., at the opening of the bottle) to be seated over the support post on the support surface of the drying rack 12 to inhibit the bottle against falling off of the support post. It is understood that the heights of the support posts 28 may be non-uniform without departing from the scope of this invention.

The drying rack 12 in one suitable embodiment may be constructed of plastic, including polypropylene, or other suitable material. The illustrated drying rack 12 is suitably of a one-piece construction, such as by molding. It is understood, however, that the support posts may be formed separate from the support surface and peripheral wall 16 of the drying rack 12 and adapted for removable mounting on the support surface in a desired pattern of support posts 28.

Drip Pan

With reference now to FIGS. 1 and 7-10, the drip pan 14 of the drying rack assembly 10 has generally the same shape as the drying rack 12 (e.g., generally rectangular in the illustrated embodiment). In one particularly suitable embodiment, the drip pan is sized slightly larger (e.g., in length and width) than the drying rack 12 so that the entire drying rack can be received in the drip pan for storage and/or transport. The illustrated drip pan 14 is suitably constructed to be reversible in that either side of the drip pan may be used. In particular, the drip pan 14 is useable in a draining configuration (e.g., FIGS. 1 and 7) or in a collecting configuration (e.g., FIG. 11).

The drip pan 14 comprises a non-porous, generally planar panel 46 and a peripheral wall 48 extending about and supporting the panel. The panel 46 and peripheral wall 48 may suitably be formed integrally, such as by molding or other suitable method, or they may be formed separate with the peripheral wall constructed to support the panel within the wall. The panel 46 is suitably angled relative to the peripheral wall 48, and more suitably relative to horizontal, so that liquid that drains into the drip pan 14 flows over the panel instead of pooling and lying stagnant on the panel. As an example, the angle of the panel 46 relative to horizontal is suitably in the range of about 3° to about 45°, and more suitably in the range of about 3° to about 8°.

Figure 7:
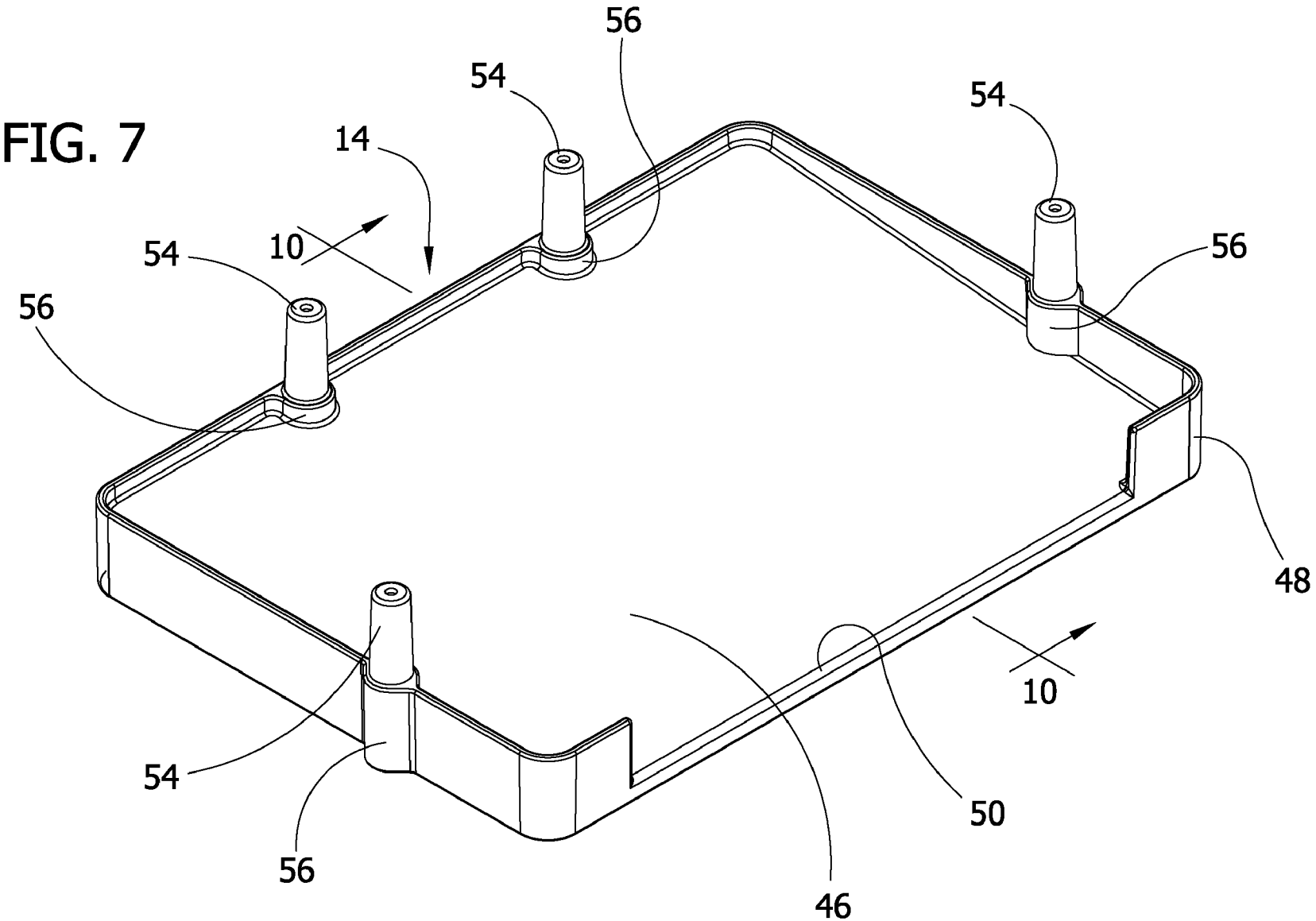
FIG. 7 is a perspective view of the drip pan of the drying rack assembly of FIG. 1, with the drip pan in a draining configuration.
Figure 7A:
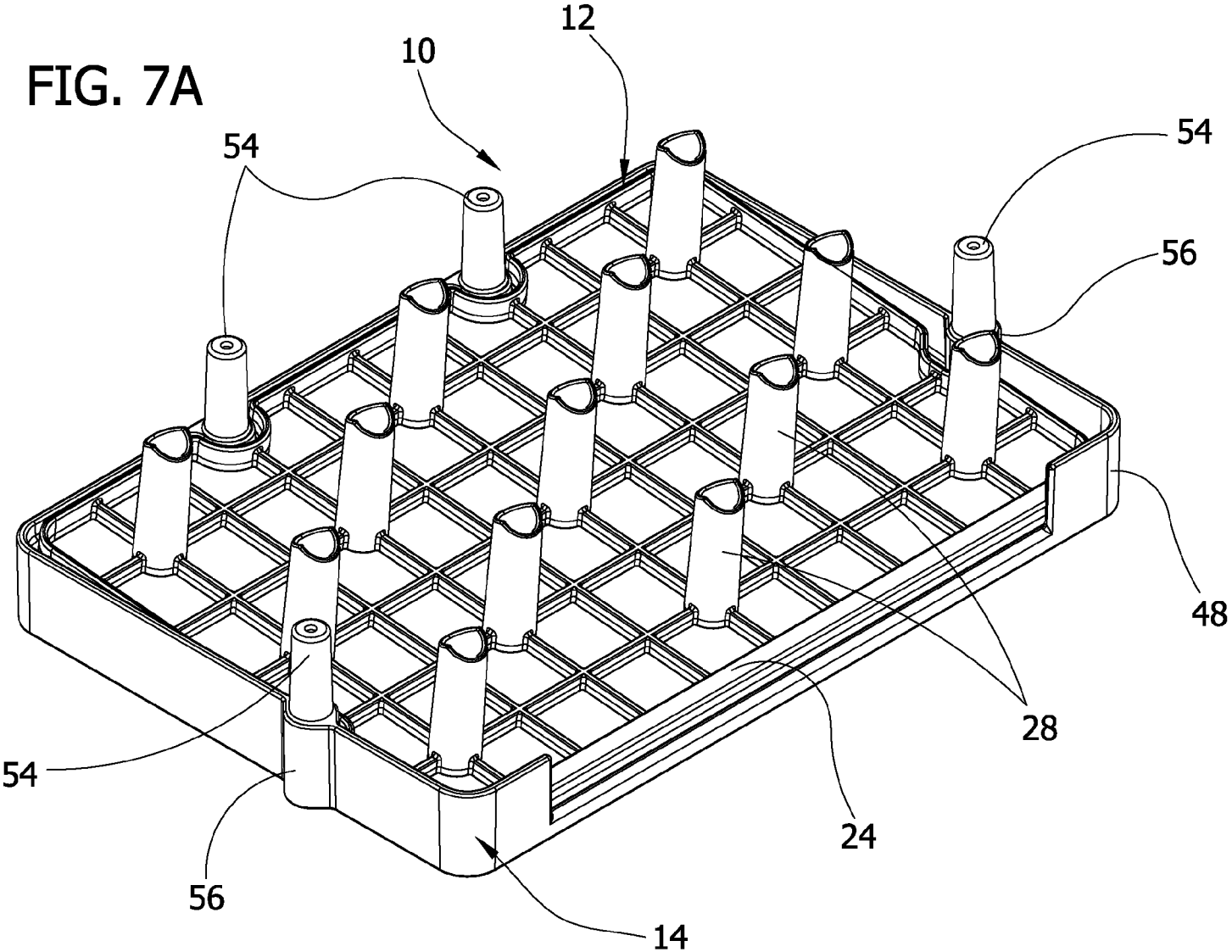
FIG. 7A is a perspective view of the drying rack assembly seated on a surface with the drip pan in its draining configuration.
Figure 8:
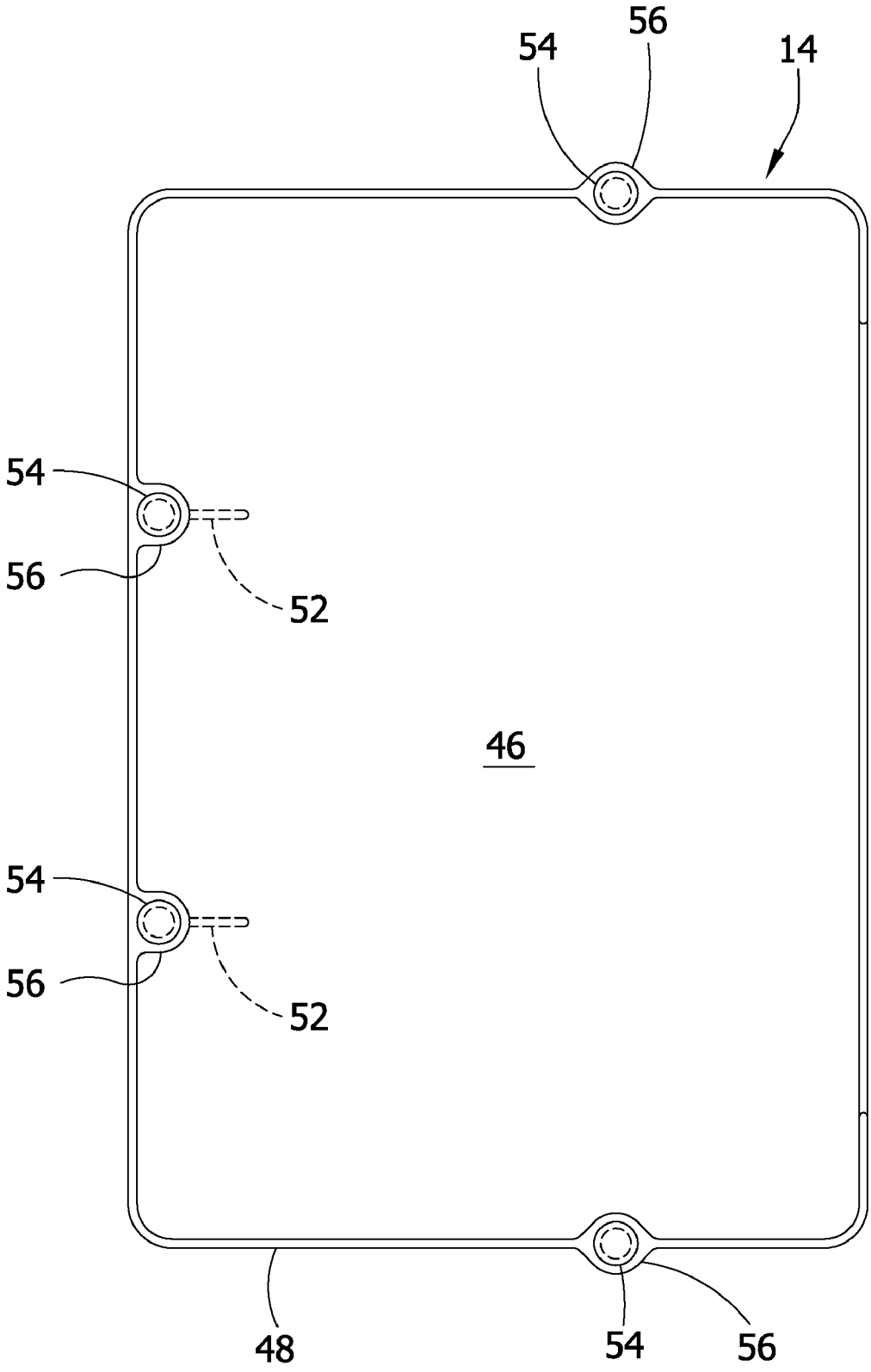
FIG. 8 is a top plan view of the drip pan of FIG. 7.

The peripheral wall 48 of the drip pan 14 extends both above and below the panel 46 in both the draining configuration and the collecting configuration to provide a generally trough-like form to both sides of the drip pan. As best seen in FIGS. 1 and 7, an elongate cut-out 50 is formed in the peripheral wall 48 of the drip pan 14 above one side of the panel 46 (e.g., the side corresponding to the draining configuration of the drip pan) to permit liquid collected by the panel to drain off of the panel and out of the drying rack assembly 10. In particular, the cut-out 50 is formed such that the bottom of the cut-out is flush with the panel 46. The cut-out 50 may extend partially along the length of the drip pan 14 as in the illustrated embodiment, or substantially the entire length thereof.

Figure 10:
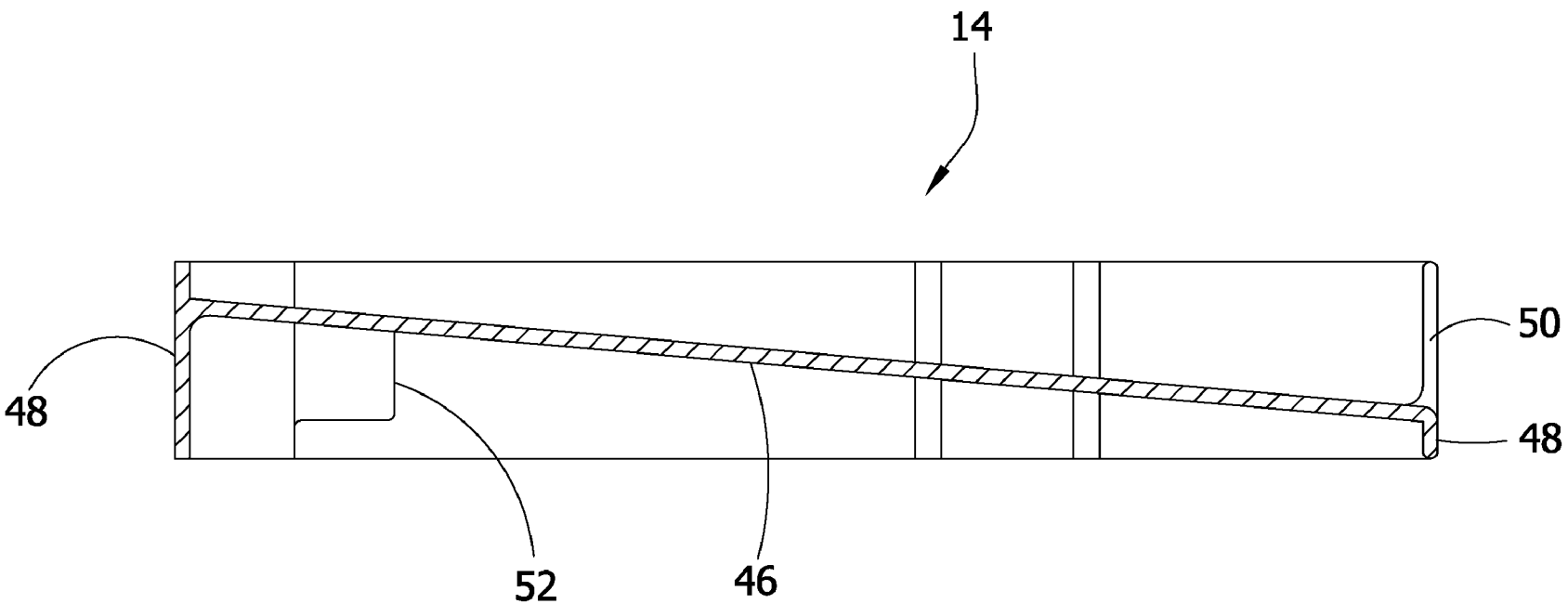
FIG. 10 is a cross-section taken in the plane of line 10-10 of FIG. 7 with posts omitted from the drawing for clarity.

As an example, in the illustrated embodiment, in the draining configuration of the drip pan 14 illustrated in FIG. 7 the peripheral wall 48 extends above the higher end of the panel 46 a distance of about 0.25 in. (0.64 cm) and above the lower end of the panel (e.g., at the cutout) a distance of about 1.0 in. (2.54 cm). On the opposite side of the drip pan 14, e.g., in the collecting configuration, the peripheral wall 48 extends above (as illustrated in FIG. 11, or below as illustrated in FIG. 10) the higher end of the panel 46 a distance of about 0.25 in. (0.64 cm) and above (or below as illustrated in FIG. 10) the lower end of the panel a distance of about 1.0 in. (2.54 cm). It is understood, however, that the height of the peripheral wall 48 above the panel 46 may be other than as set forth above without departing from the scope of this invention.

In the draining configuration of the drip pan 14, as shown in FIG. 1, to assemble the drying rack assembly 10 the drying rack 12 is placed on the drip pan with the front of the drying rack adjacent the cut-out 50 in the peripheral wall 48 of the drip pan. The flange 24 extending along the front of the drying rack 12 extends over the wall 48 of the drip pan 14 at the ends of the cut-out 50 with the wall of the drip pan received in the channel 26 formed between the flange and the peripheral wall 16 of the drying rack to secure the drying rack on the drip pan. The back of the drying rack 12 rests on the drip pan panel 46 slightly inward from the peripheral wall 48 of the drip pan 14. It is understood, however, that ribs (not shown) or other riser structure may extend up from the drip pan panel 46 inward of the peripheral wall 48 to support the back of the drying rack 12. The drying rack 12 is thus supported by the drip pan 14 generally level, e.g., horizontal, above the angled drip pan panel 46. In this draining configuration, liquid runoff from the drying rack 12 runs down along the angled drip pan panel 46 and out of the drip pan 14 via the cut-out 50. As an example, the drying rack assembly 10 can be placed adjacent a sink with the cut-out 50 facing the sink to permit liquid runoff to drain into the sink.

Figure 9:
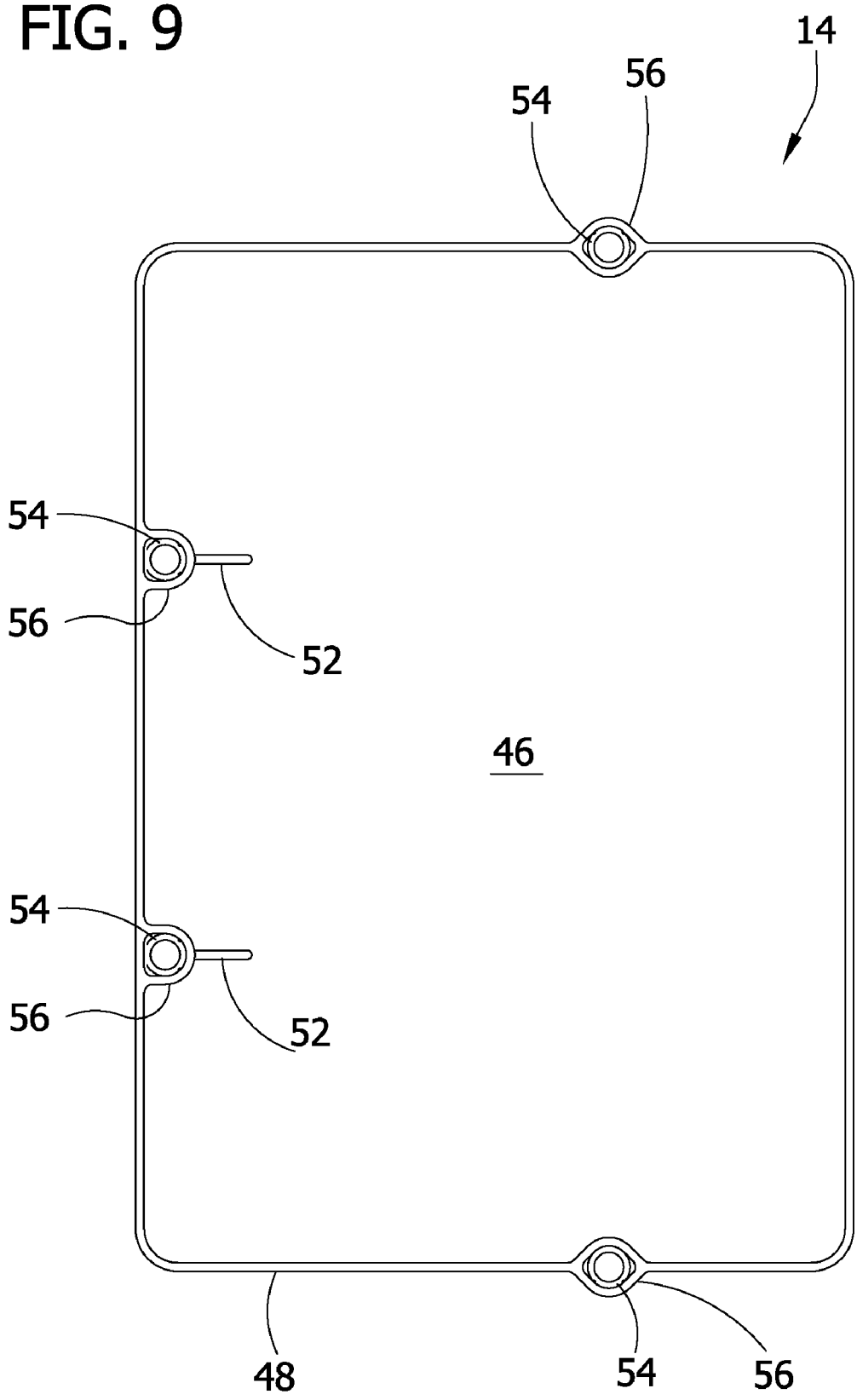
FIG. 9 is a bottom plan view thereof.

In the collecting configuration, such as shown in FIG. 11, the drip pan 14 is flipped over such that the cut-out 50 in the peripheral wall 48 of the drip pan faces downward so that liquid is collected and retained by the drip pan. The front of the drying rack 12 is disposed adjacent the higher end of the panel 46 with the flange 24 seated over the peripheral wall 48 of the drip pan 14. Alternatively, the drying rack 12 may be disposed entirely within the peripheral wall 48 of the drip pan 14. As shown in FIGS. 9 and 10, a pair of rib members 52 projects inward from the peripheral wall 48 of the drip pan 14 at the lower end of the panel 46 to support the back end of the drying rack 12 in a level, or horizontal orientation. In this collecting configuration, liquid runoff from the drying rack 12 runs down the panel 46 of the drip pan 14 to the lower end of the panel and pools within the drip pan.

Referring now in particular to FIGS. 7-9 and 12, a set of four posts 54 extend outward (e.g., upward in the draining configuration of the drip pan 14) of the peripheral wall 48 of the drip pan 14. More particularly in the illustrated embodiment, a set of four cylindrical bases 56 is formed integrally with the peripheral wall 48 of the drip pan 14. Each base 56 is generally tubular and a respective one of the posts 54 is mounted on (and in the illustrated embodiment formed integrally with) the base at one end thereof corresponding to the upper end of the base in the draining configuration of the drip pan 14. Accordingly, when the drip pan 14 is in the draining configuration, the posts 54 extend upward (FIG. 1) and in the collecting configuration the posts extend downward (FIG. 11) and support the drying rack assembly 10 in an elevated position above the surface on which the drying rack assembly is placed. It is understood, however, that the posts 54 may be configured to project in a direction opposite the direction of the illustrated embodiment (e.g., so that drying rack 12 is elevated in the draining configuration).

Referring still to FIGS. 7-9 and 12, a respective portion of the each of the cylindrical bases 56 projects inward of the drip pan 14. The recesses 20 formed in the peripheral wall 16 of the drying rack 12 are suitably sized to accommodate the inward extension of the respective base 56. It is understood, however, that the bases 56 on which the posts 54 are formed may be disposed exterior of the drip pan 14 (e.g., connected to the outside of the peripheral wall 46 of the drip pan) such that the recesses 20 in the drying rack 12 may be omitted. In the illustrated embodiment, the cylindrical bases 56 have a height equal to the height of the peripheral wall 48 of the drip pan 14. However, these bases 56 may be sized higher or lower than the drip pan peripheral wall 48 height within the scope of this invention.

Figure 12:
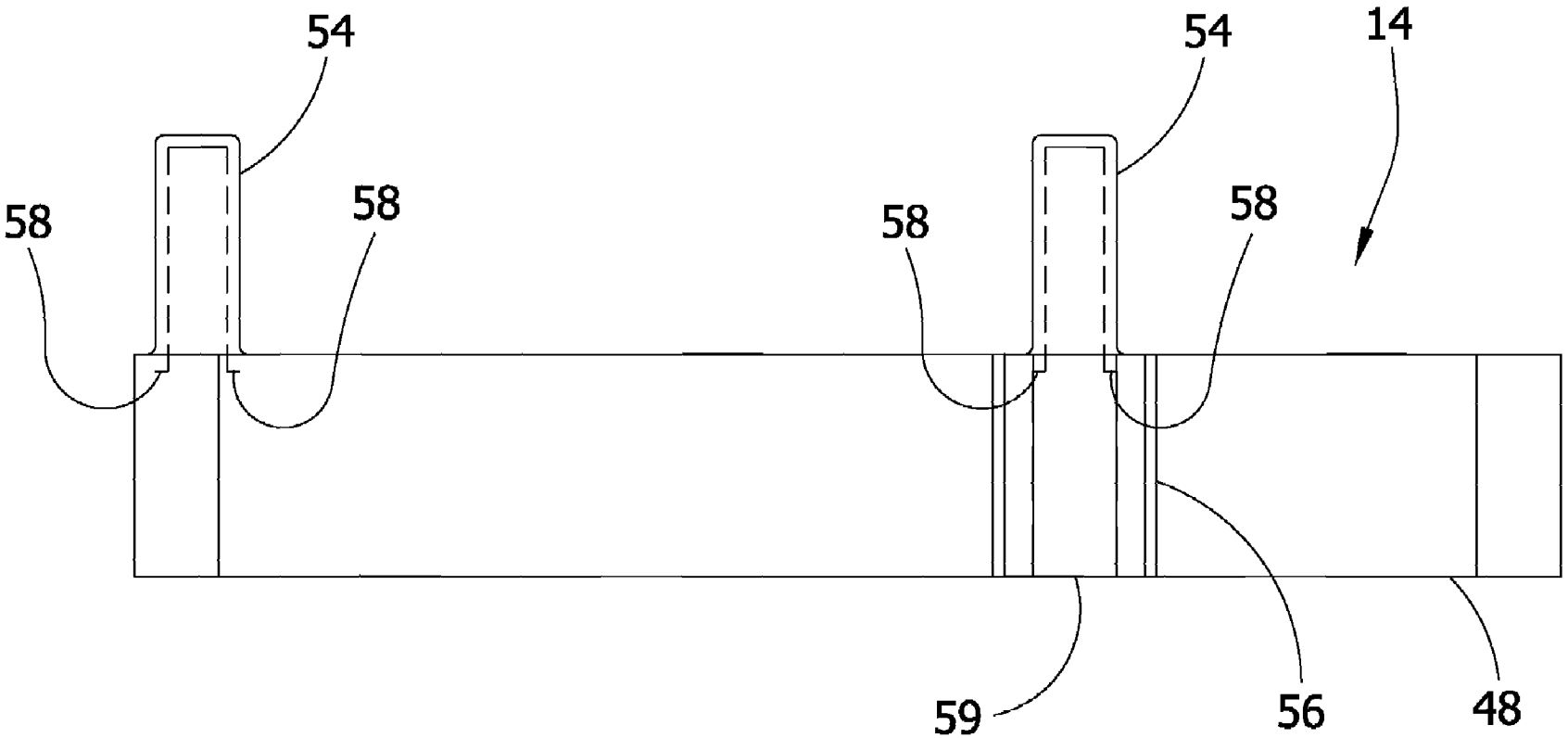
FIG. 12 is a side elevation of the drip pan of FIG. 7, with posts formed integrally with the drip pan.

In a particularly suitable embodiment, the drying rack assembly 10 is configured to facilitate construction of a drying rack system comprised of at least two drying rack assemblies stacked one upon another to more efficiently utilize countertop space while air-drying baby bottles (e.g., a bottle and associated components). For example, in one embodiment as illustrated in FIGS. 9 and 12, each of the posts 54 mounted on the cylindrical base 56 is generally tubular to together with the tubular base define a shaft. The end 59 of each of the cylindrical bases 56 opposite the outward extending post 54 is suitably open to provide access to this shaft. The shaft has a stepped diameter, e.g., with the diameter of the portion of the shaft within the post 54 being narrower than the portion of the shaft within the base 56 to define a shoulder 58, or stop within the shaft. As an example, a diameter of the portion of the shaft within the post 54 may be in the range of about 0.125 in. (0.32 cm) to about 0.75 in. (1.91 cm), and more suitably about 0.35 in. (0.89 cm) while the portion of the shaft within the base 56 may have a diameter in the range of about 0.25 in. (0.64 cm) to about 1 in. (2.54 cm), and more suitably about 0.50 in. (1.27 cm).

Referring to FIGS. 13-18, a plurality of leg extensions, generally indicated at 60, are shown for use in stacking multiple drying rack assemblies 10 to form a drying rack system. While not shown in the drawings, in the draining configuration illustrated in FIG. 14 these leg extensions 60 also allow the front of the assembly 10 to be positioned out over the lip of a sink while maintaining the assembly level. As shown best in FIG. 18, each leg extension 60 has an elongate cylindrical body 62 projecting from a cylindrical foot 64 of the extension. The foot 64 of the extension 60 has a cavity 66 axially aligned with the leg extension.

Figure 15:
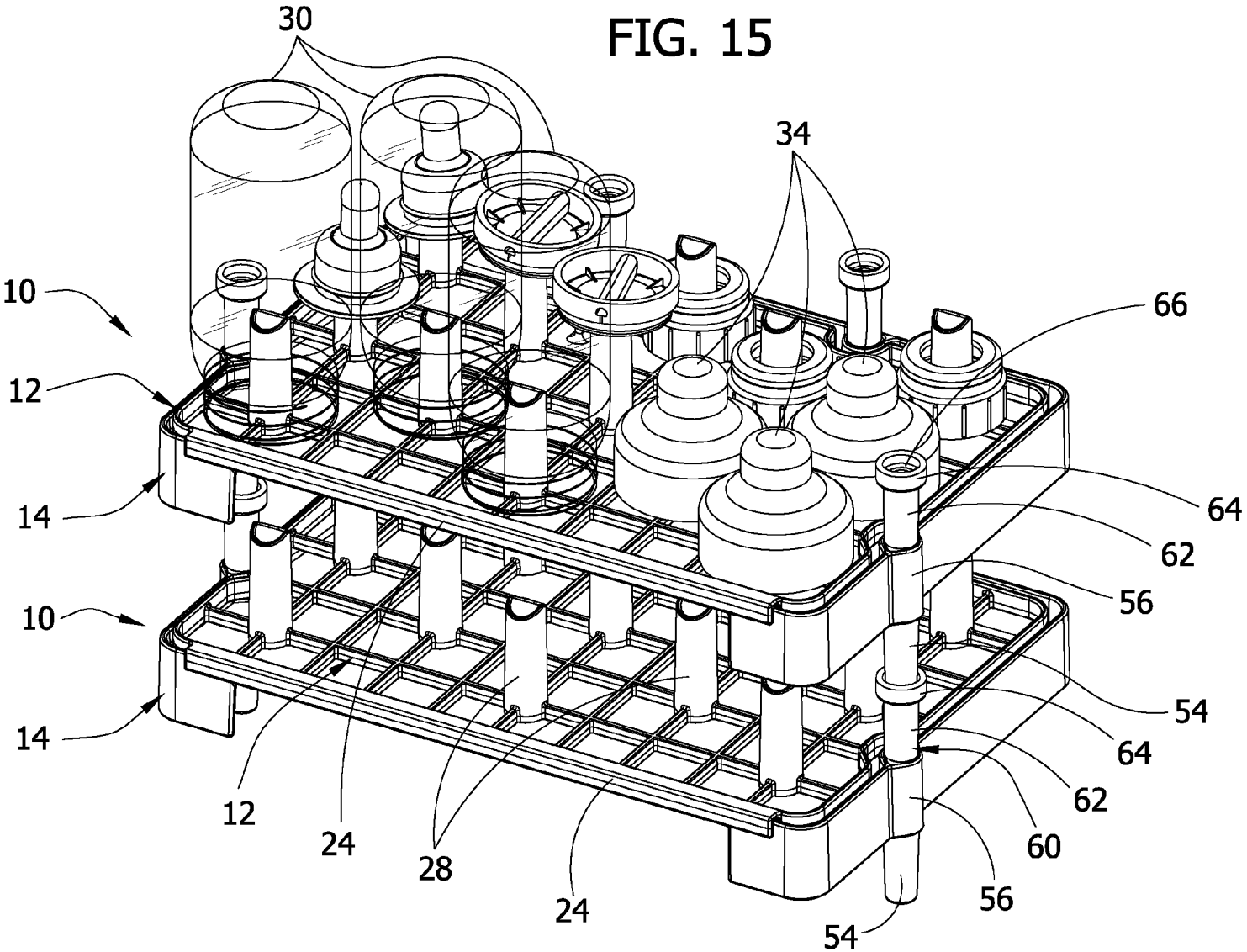
FIG. 15 is a perspective view of a drying rack system in which one drying rack assembly is stacked on a second drying rack assembly, with the drip pan of each assembly in its collecting configuration.
Figure 16:
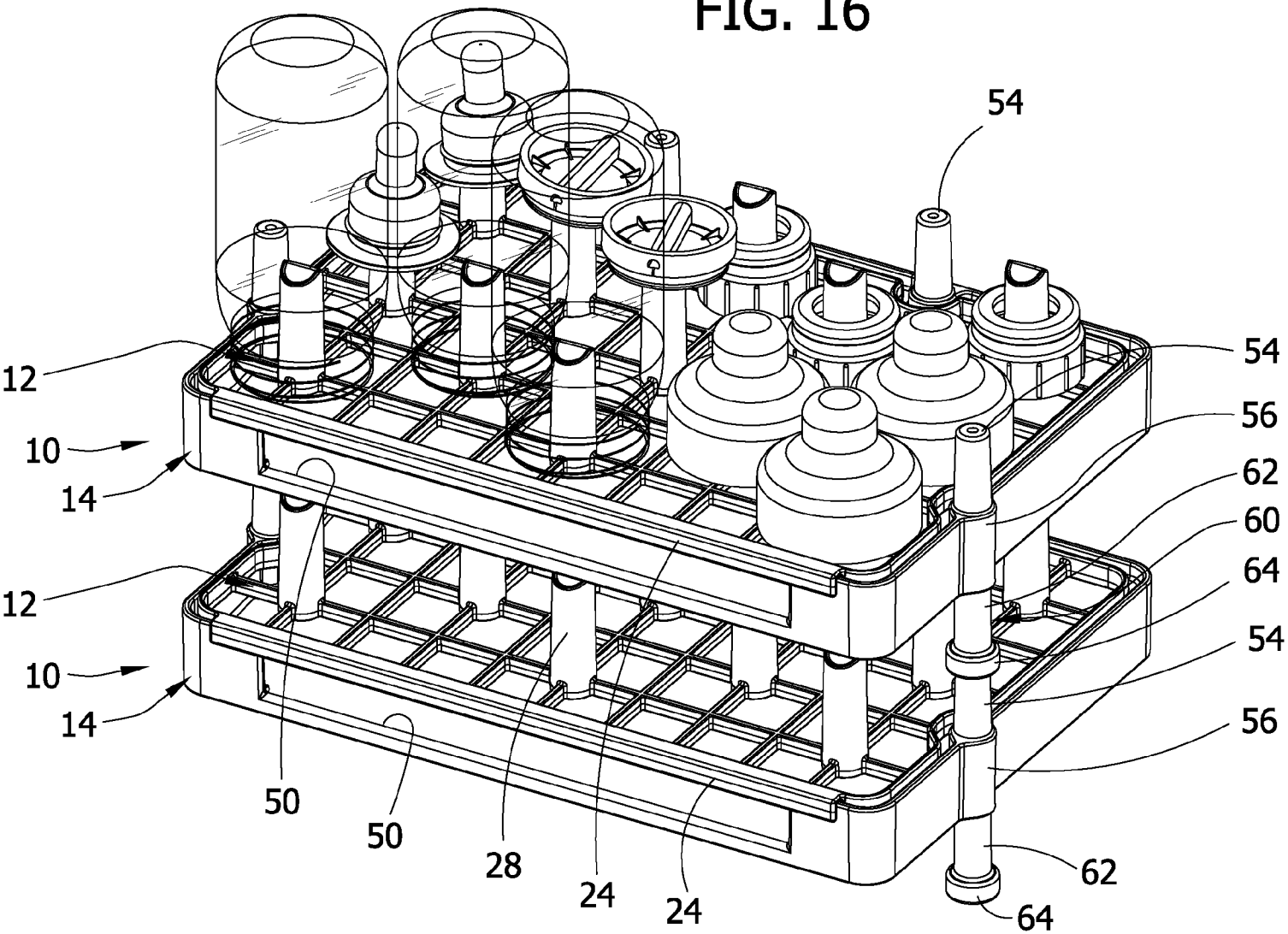
FIG. 16 is a perspective view of the drying rack system of FIG. 15 with the drip pan of each drying rack assembly in its draining configuration.
Figure 17:
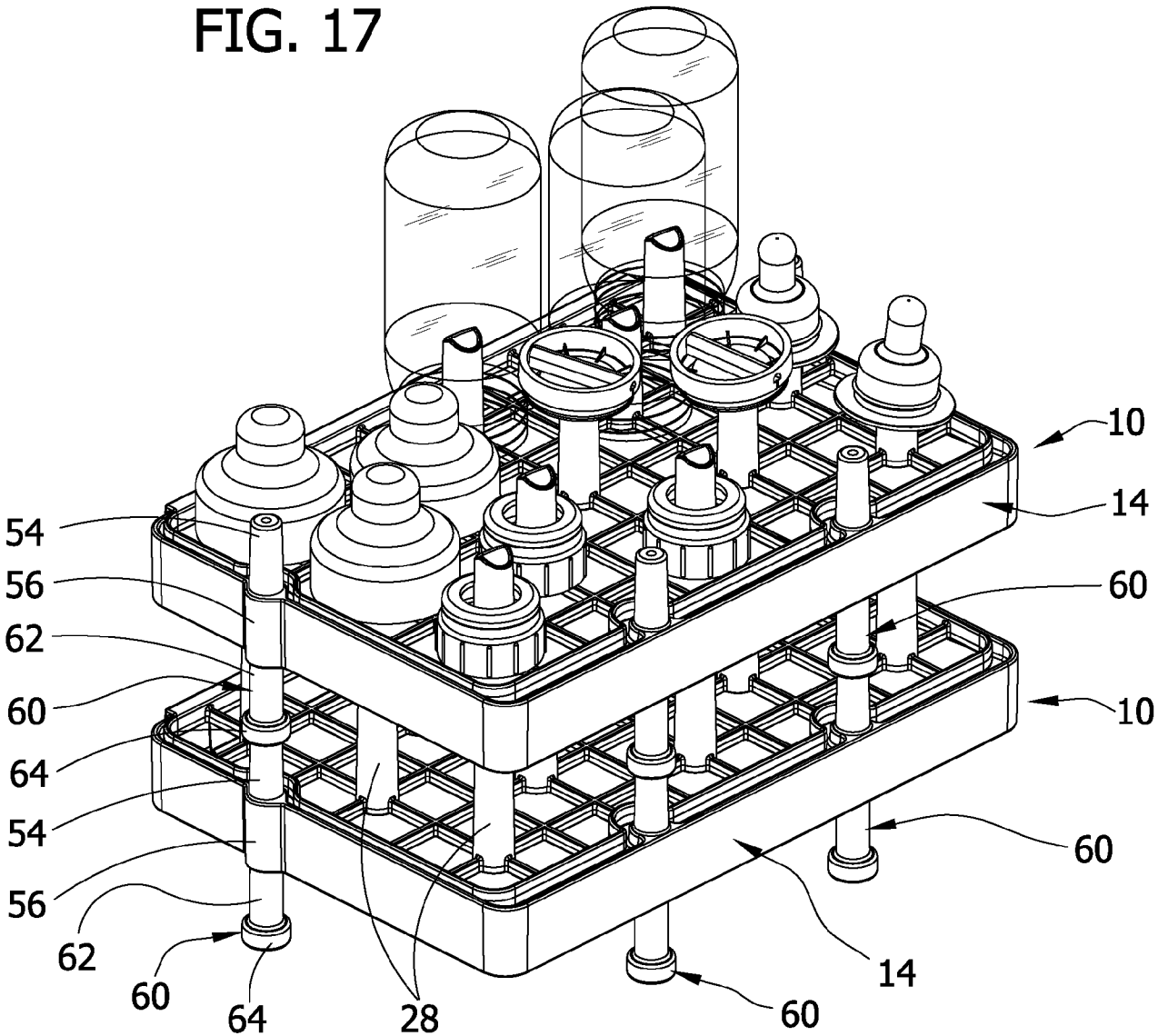
FIG. 17 is another perspective view of the drying rack system of FIG. 16.
Figure 18:
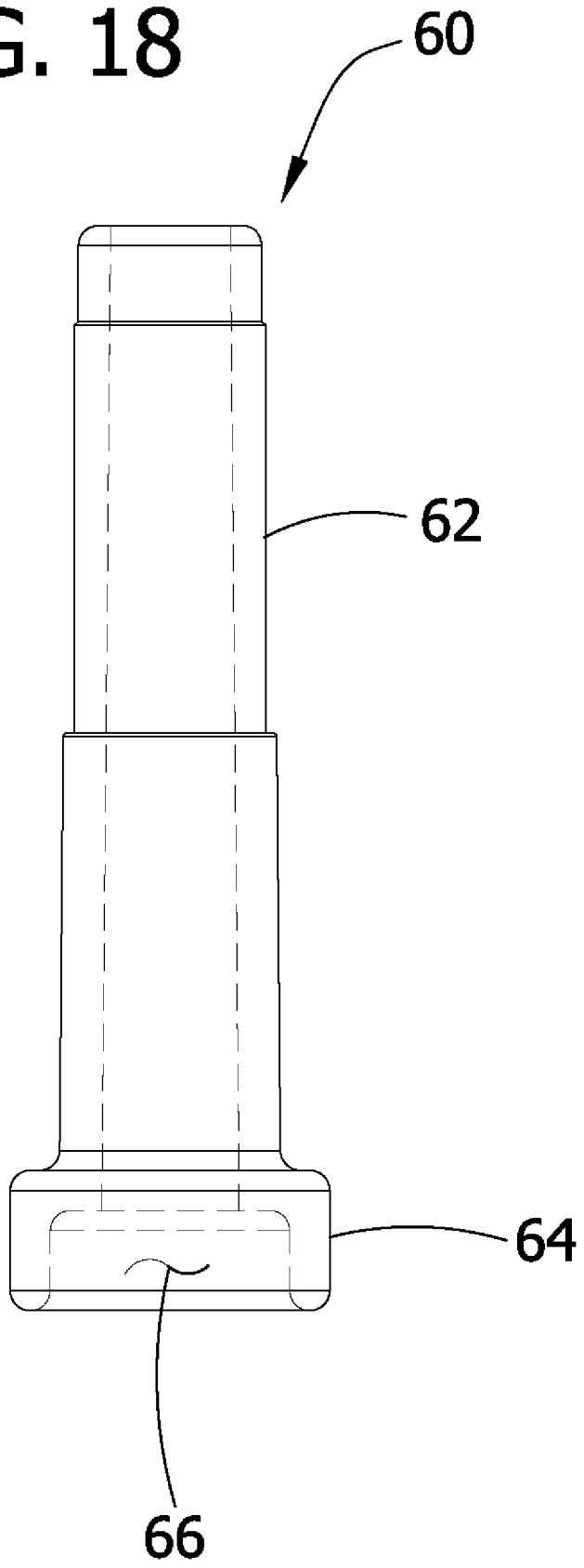
FIG. 18 is a side elevation of a leg extension of the drying rack assembly of FIG. 13.
Figure 19:
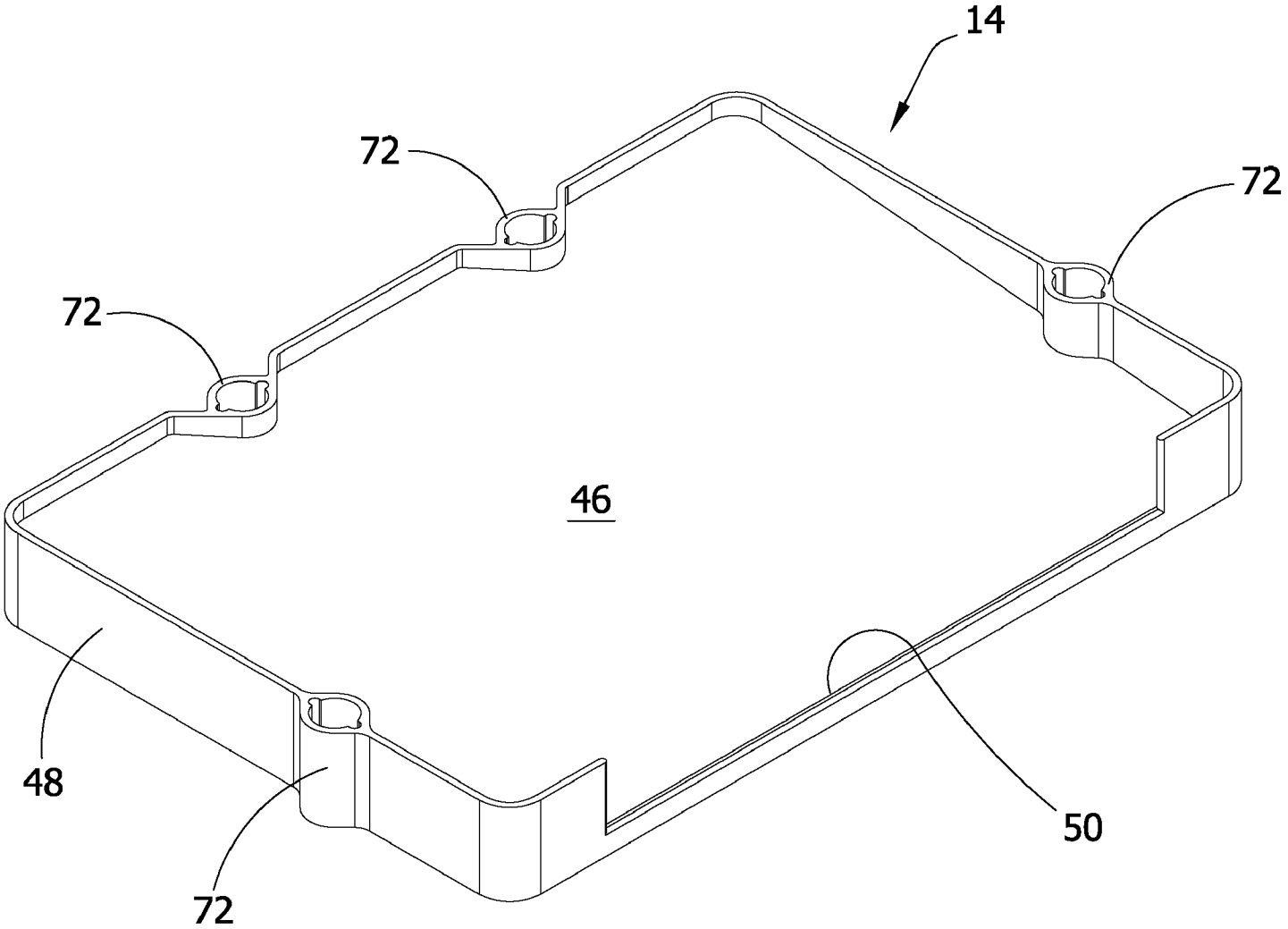
FIG. 19 is a perspective view of a drip pan of a second embodiment of a drying rack assembly, with the drip pan in a draining configuration.
Figure 20:
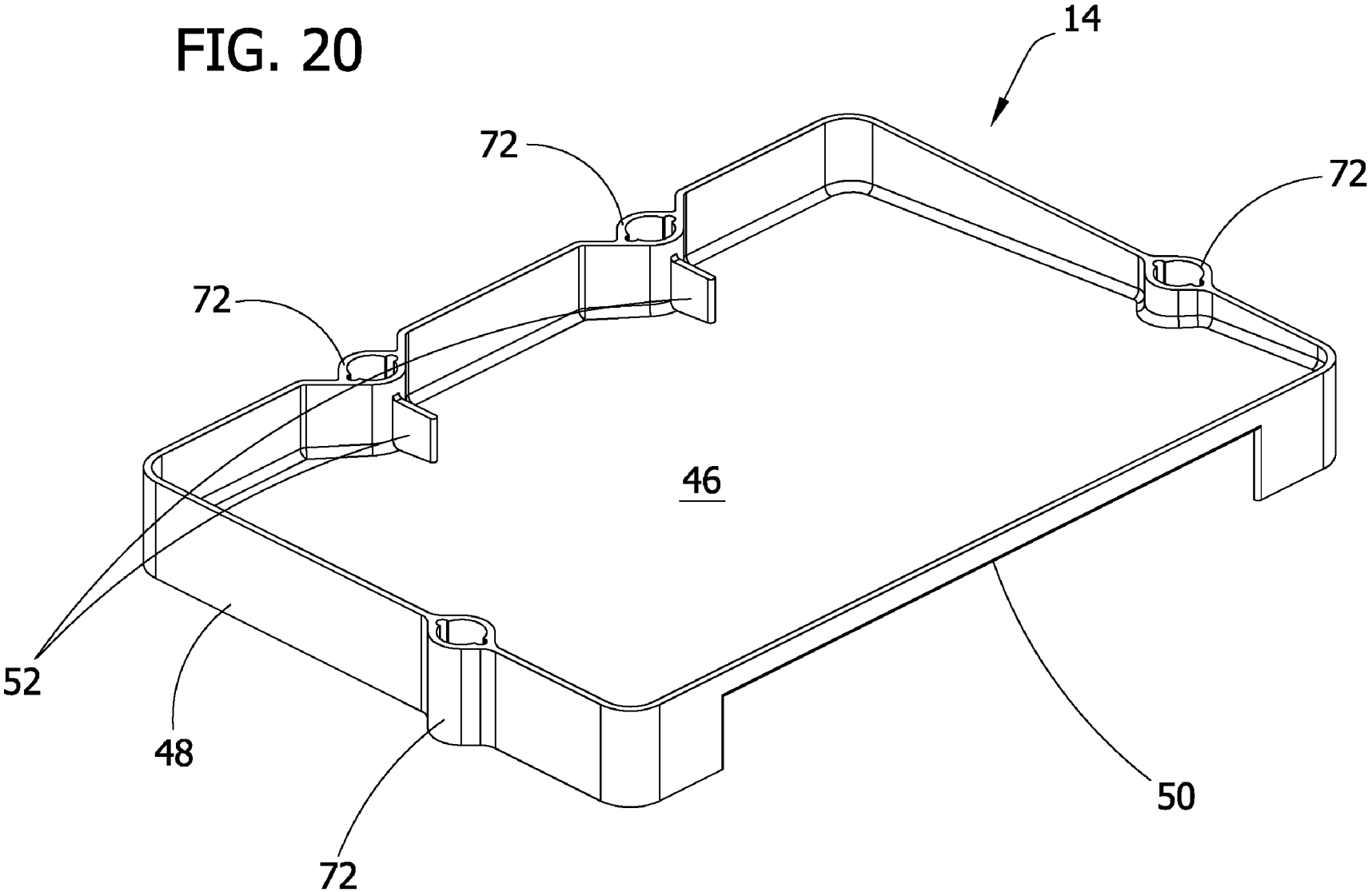
FIG. 20 is a perspective view of the drip pan of FIG. 19 with the drip pan in a collecting configuration.
Figure 21:
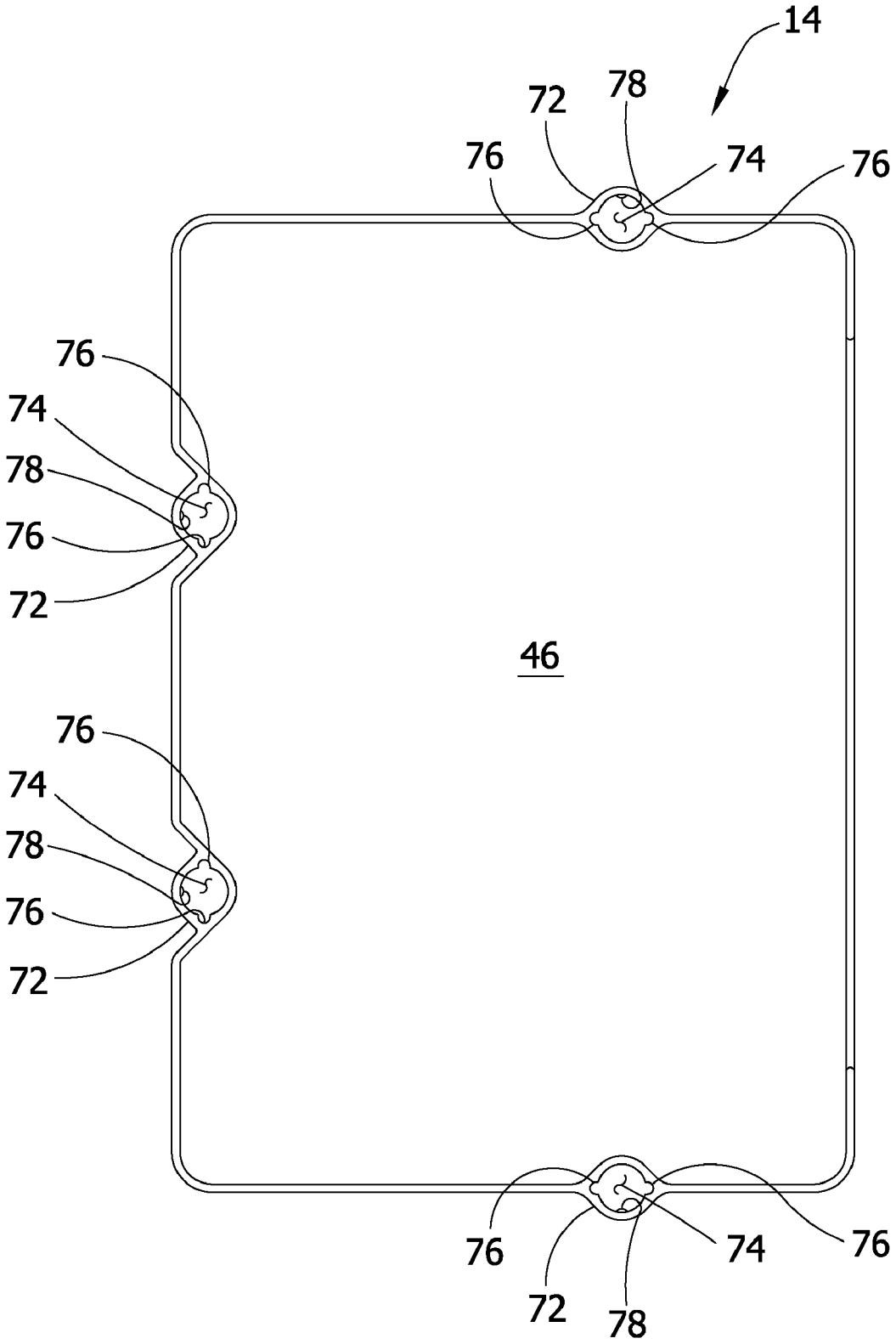
FIG. 21 is a top plan view of the drip pan of FIG. 19.
Figure 22:
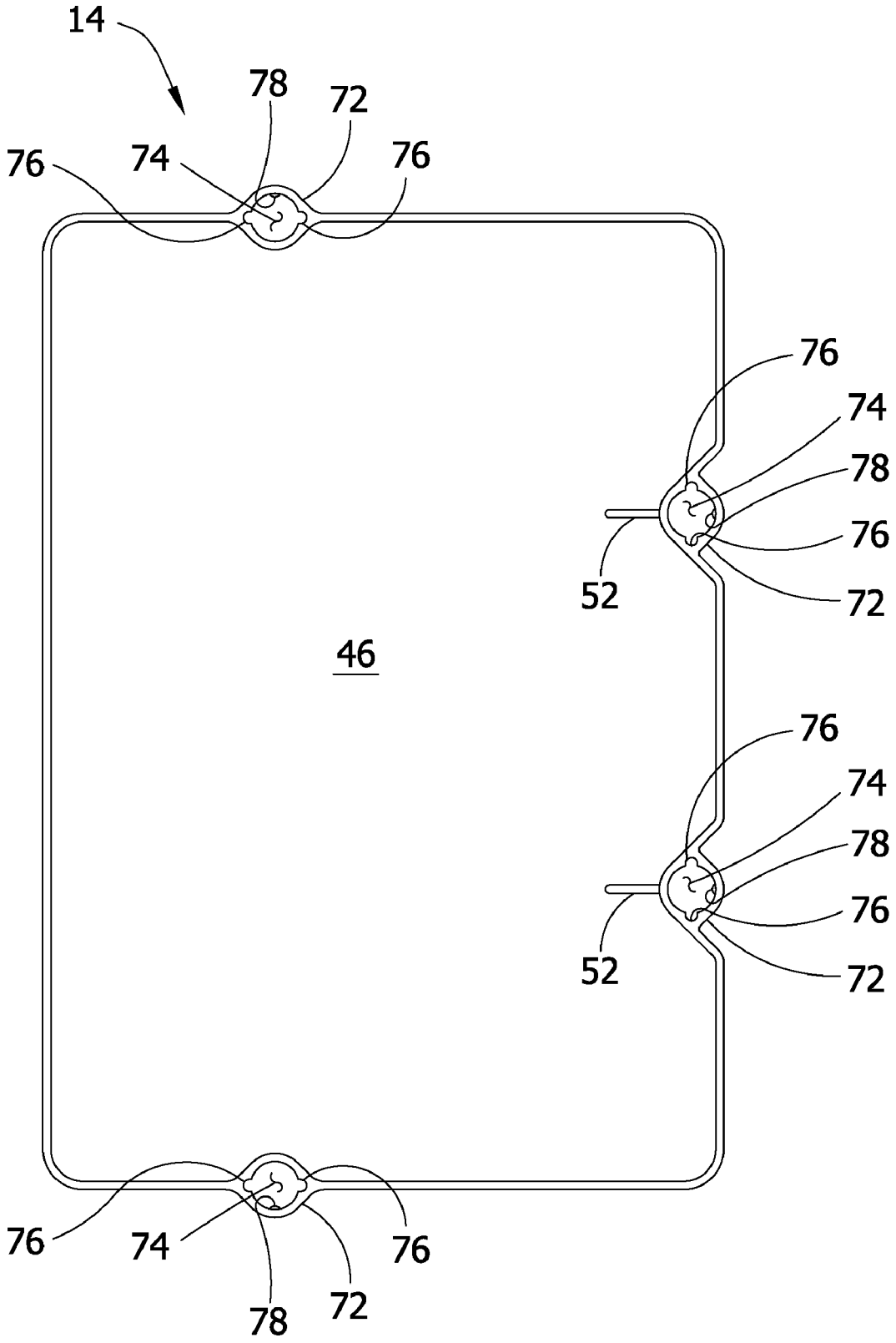
FIG. 22 is a bottom plan view thereof.
Figure 23:
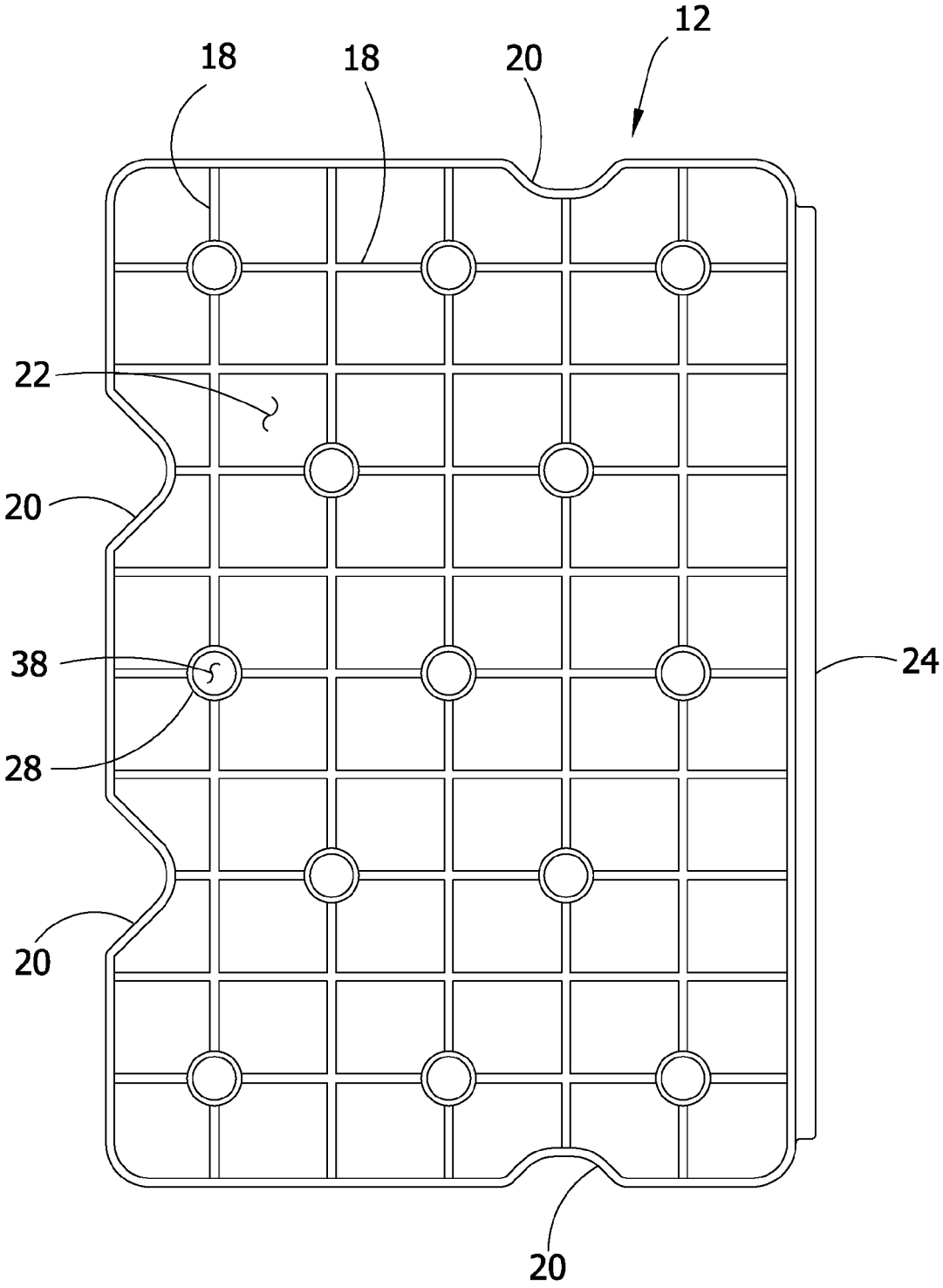
FIG. 23 is a top plan view of a drying rack of the second embodiment of the drying rack assembly.

As shown in FIGS. 15-17, multiple drying rack assemblies 10 may be stacked vertically by inserting the bodies 62 of the leg extensions 60 in the respective opening 59 in the cylindrical bases 56 of one drying rack assembly and inserting the shafts of the posts 54 of another drying rack assembly into the cavities 66 of the corresponding leg extension. The diameter of the leg extension body 62 may be such that the body contacts the shoulder 58 within the shaft of the base 56 of the drying rack assembly 10 when the body is received within the shaft. The body 62 of the leg extension 60 may have a length greater than that of the base 56 portion of the shaft such that the leg extension extends out of the base when received in the shaft. It will be understood that the spacing between stacked drying rack assemblies 10 is dependent, at least in part, on the lengths of the posts 54 that extend from the drying rack assembly, and on the lengths of the leg extensions 60.

The stacked drying rack assemblies 10 may be configured in either the draining configuration or the collecting configuration. For example, as shown in FIG. 15, both the upper and lower drying rack assemblies 10 are configured in the collecting configuration, and in FIG. 16 both drying rack assemblies 10 are in the draining configuration. The leg extensions 60 may be used to elevate one of the drying rack assemblies 10 above the surface on which the assembly is placed as illustrated in FIG. 14, or to elevate the drying rack system (of multiple drying rack assemblies) as illustrated in FIGS. 16 and 17.

Sizing the drip pan 14 to receive entirely therein the drying rack 12 also allows convenient packaging of a drying rack system that consists of two drying rack assemblies 10. In particular, one of the drip pans may be oriented in its draining configuration with the drying rack seated down in the drip pan (e.g., on the angled drip pan panel 46). The drip pan 14 of the other drying rack assembly 10 is inverted and the drying rack is placed within the drip pan on the angled drip pan panel 46). The drip pans are aligned and placed, one on top of the other, with the deeper end (e.g., the end having the elongate opening 50) of the drip pan on top being aligned with the shallow end of the drip pan on the bottom, and vice-versa. In this manner, the upward extending support posts 28 of the drying rack 12 of the lower drying rack assembly 10 and the downward extending posts of the drying rack of the upper drying rack assembly are all housed between the drip pans 14 to permit a compact packaging configuration of the two drying rack assemblies.

Figure 24:
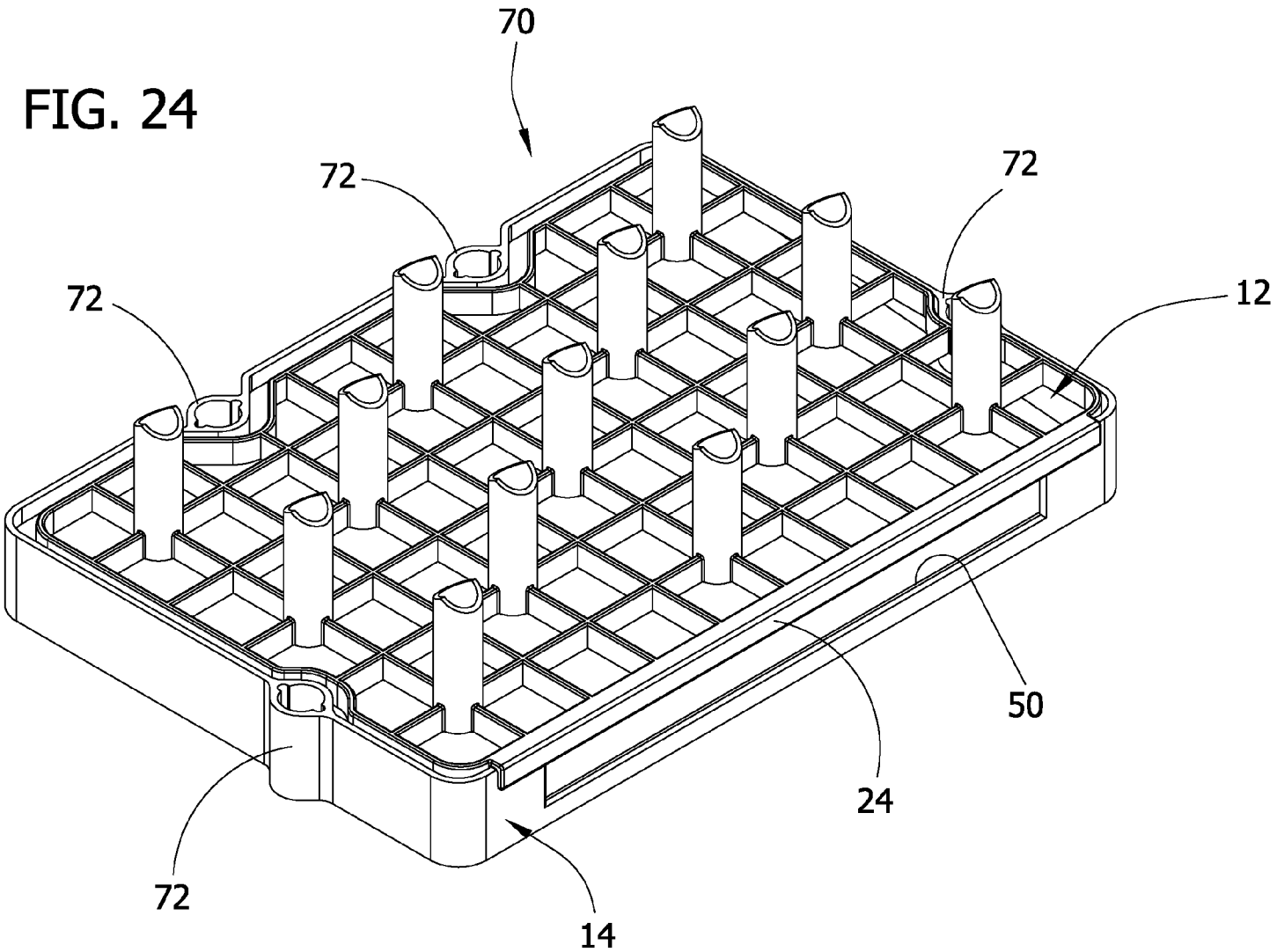
FIG. 24 is a perspective view of the second embodiment of the drying rack assembly including the drip pan and the drying rack, with the drip pan it its draining configuration.
Figure 25:
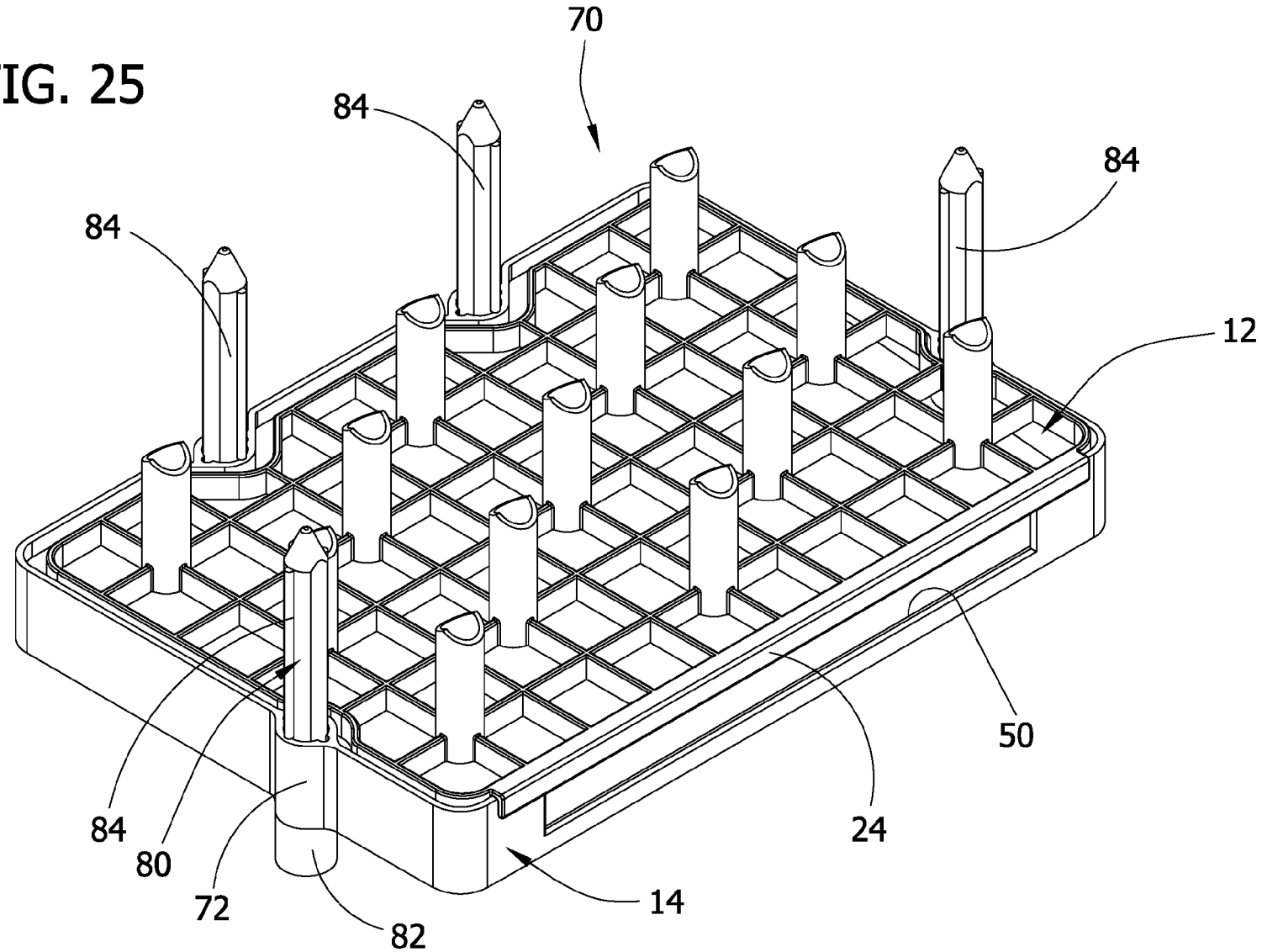
FIG. 25 is a perspective view similar to that of FIG. 24 with stacking posts inserted in the drip pan.
Figure 26:
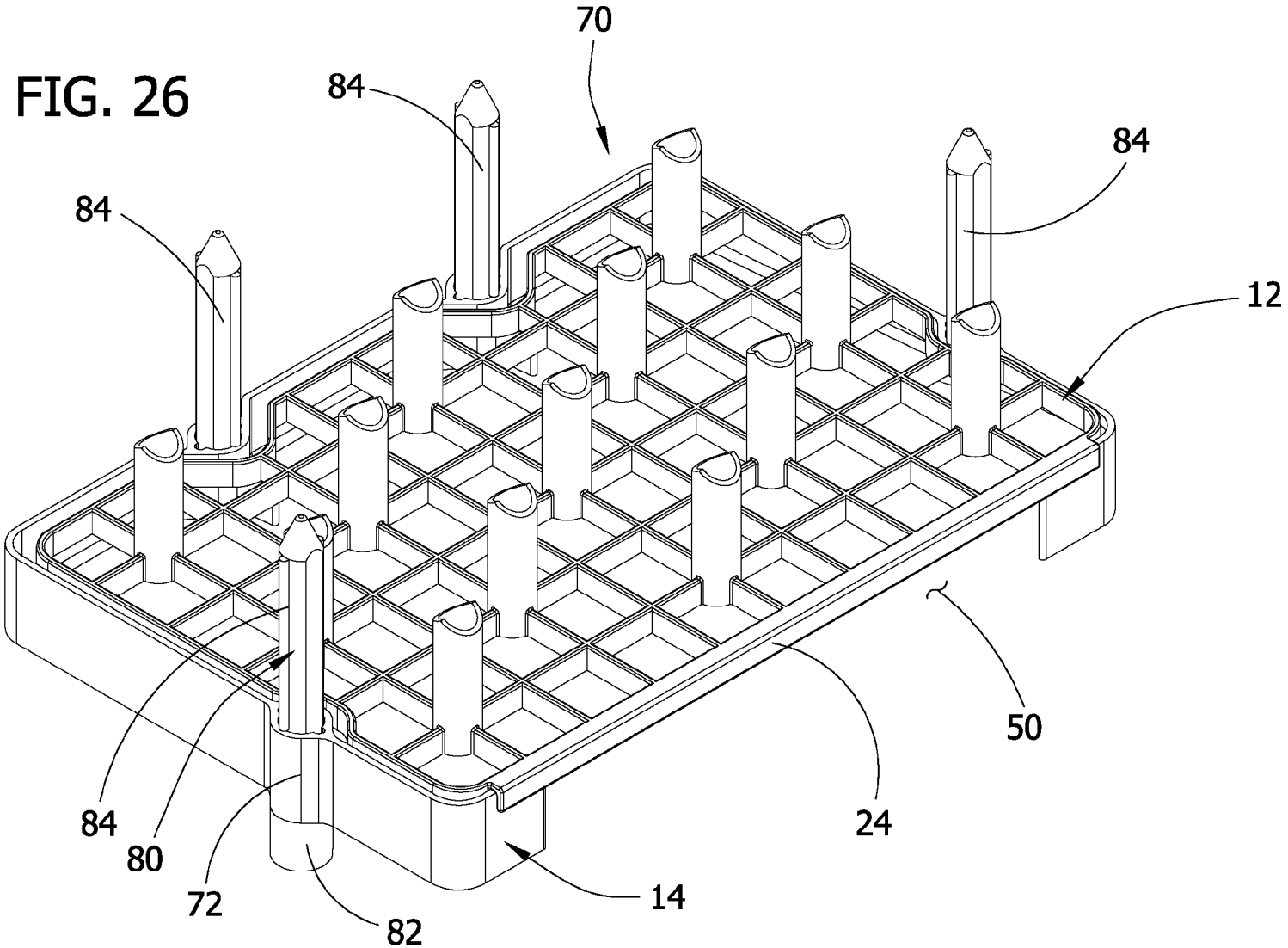
FIG. 26 is a perspective view of the drying rack assembly of the second embodiment with the drip pan in its collecting configuration and stacking posts inserted in the drip pan.
Figure 27:
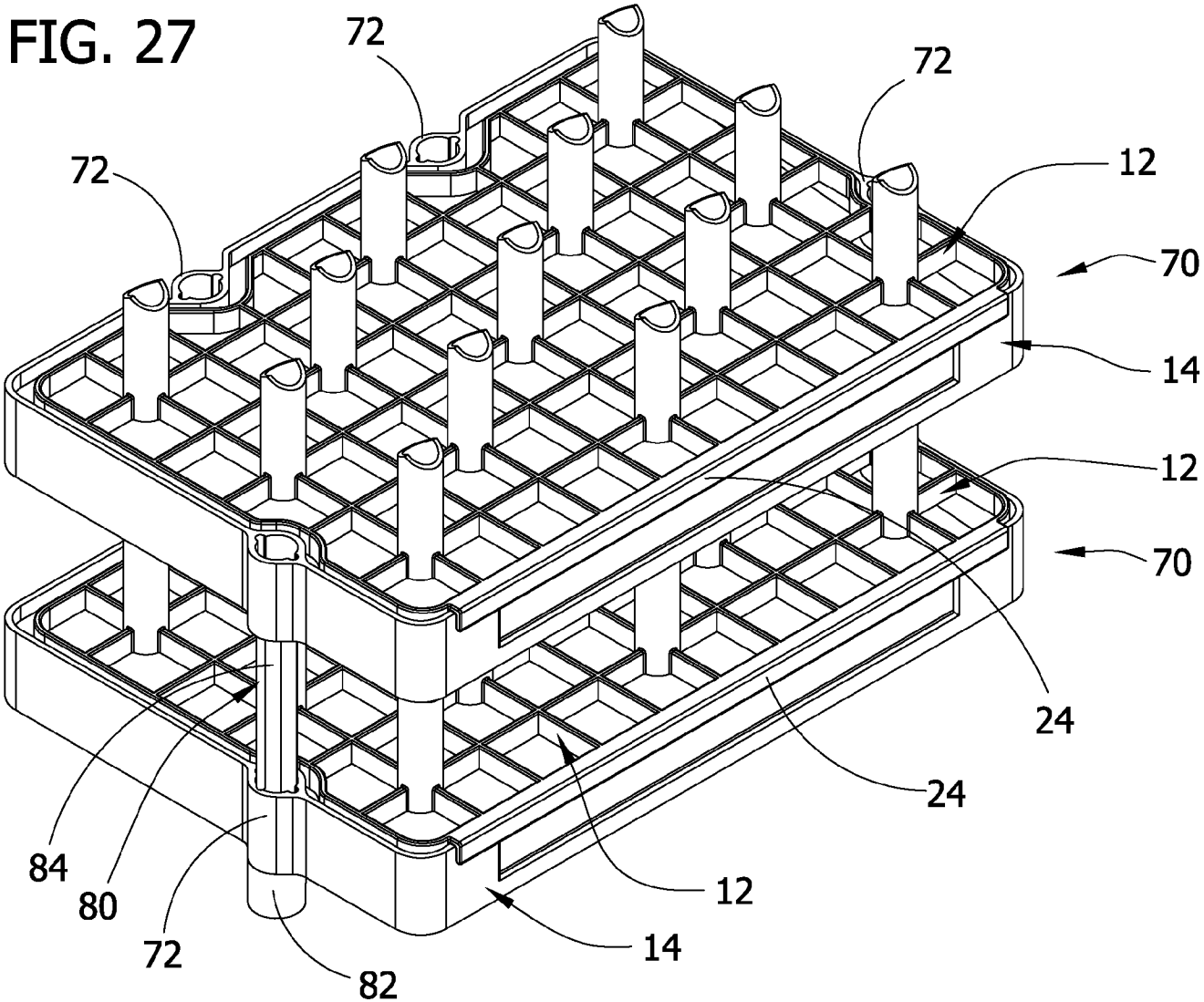
FIG. 27 is a perspective view of a drying rack system in which one drying rack assembly of the second embodiment is stacked on a second drying rack assembly of the second embodiment, with the drip pan of each drying rack assembly in its draining configuration.
Figure 28:
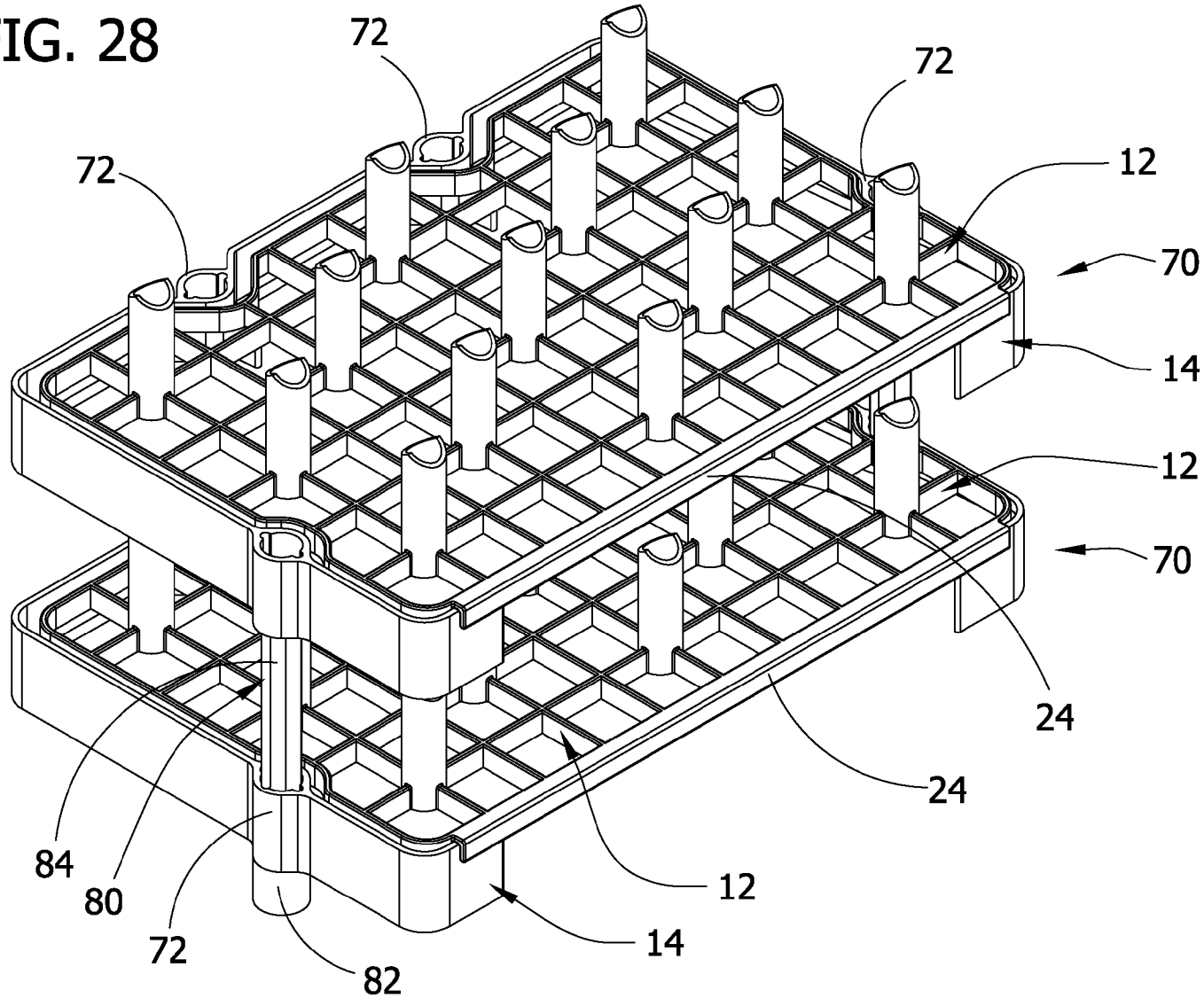
FIG. 28 is a perspective view of the drying rack system of FIG. 27 with the drip pan of each drying rack assembly in its collecting configuration.
Figure 29:
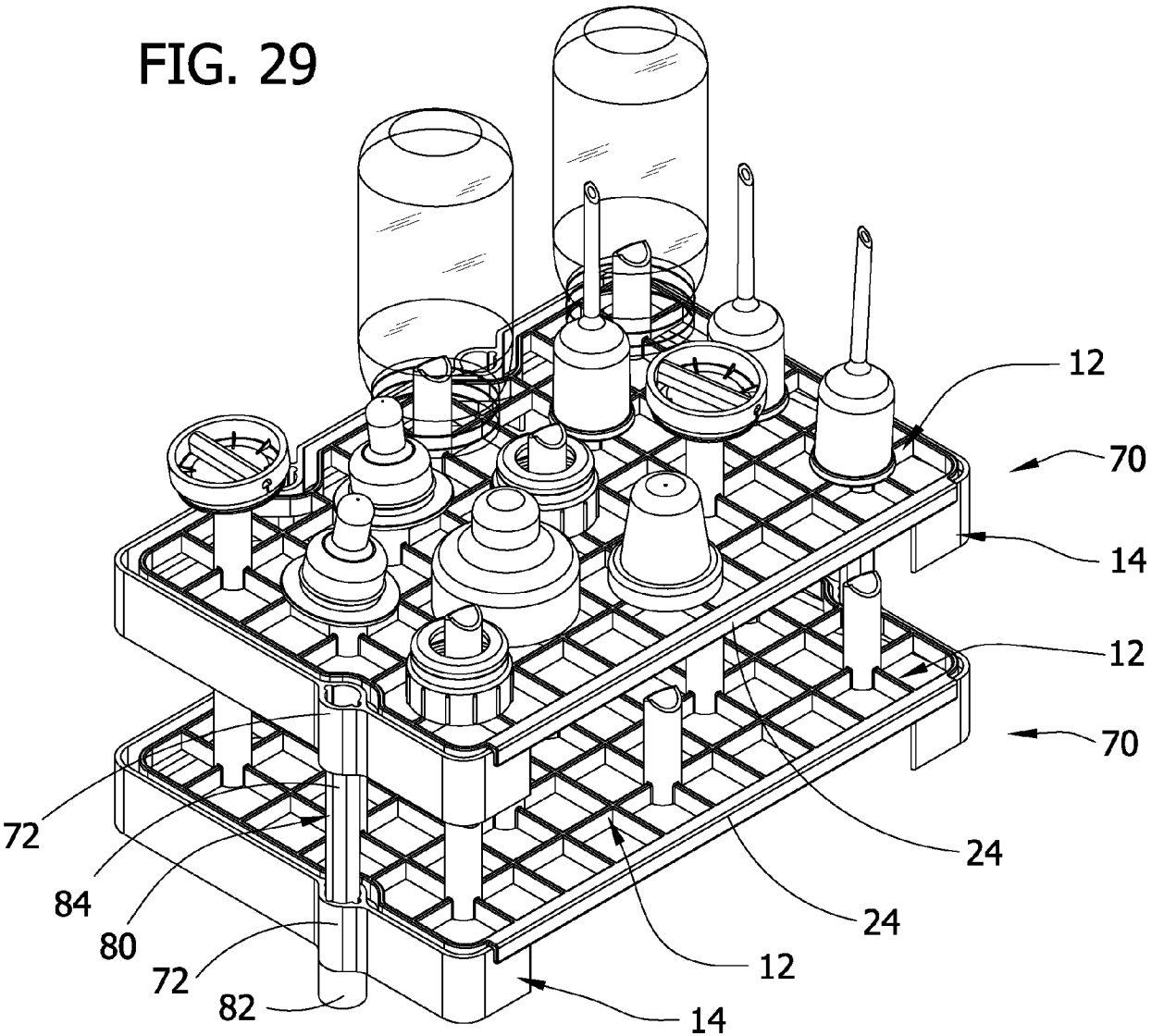
FIG. 29 is a perspective view similar to FIG. 28 with multiple baby bottle components supported by the drying rack of the uppermost drying rack assembly.

Referring now to FIGS. 19-30, and in particular to FIG. 24, a second embodiment of a drying rack assembly configured to permit stacking of two or more assemblies to form a drying rack system is generally indicated at 70. This embodiment is substantially similar to the above-described embodiment of FIGS. 1-18 with the exception of the configuring of the assembly 70 to permit stacking. For convenience, corresponding components of this embodiment will be represented by the same respective reference numbers as in the previous embodiment.

In this embodiment, the cylindrical bases and posts of the drying rack assembly are replaced by sleeves 72 formed integrally with the peripheral wall 48 of the drip pan 14. Each sleeve 72 defines an internal passage 74 extending between open ends of the sleeve. Opposed slots 76 are formed in the sleeves 72 and are open to the internal passage 74 along the heights of the sleeves. A nub 78 (FIG. 21, broadly, a stop) projects from the sleeve inward into the internal passage thereof. It is understood that other structural features could broadly act as stops, such as, for example, a flat, wherein corresponding flats are provided on the stacking pins 80.

With reference now to FIGS. 25-30, the present embodiment also comprises stacking pins, generally indicated at 80, that are different from the leg extensions of the previous embodiment. Each stacking pin 80 comprises a generally cylindrical base 82 and a generally cylindrical post 84 extending from and connected to the base. The posts 84 of the stacking pins 80 are suitably sized and shaped for being received in the respective sleeves 72 of the drip pan 14, with the base 82 of each stacking pin being sized in cross-section larger than that of the post to prevent entry of the base into the sleeve.

Figure 30:
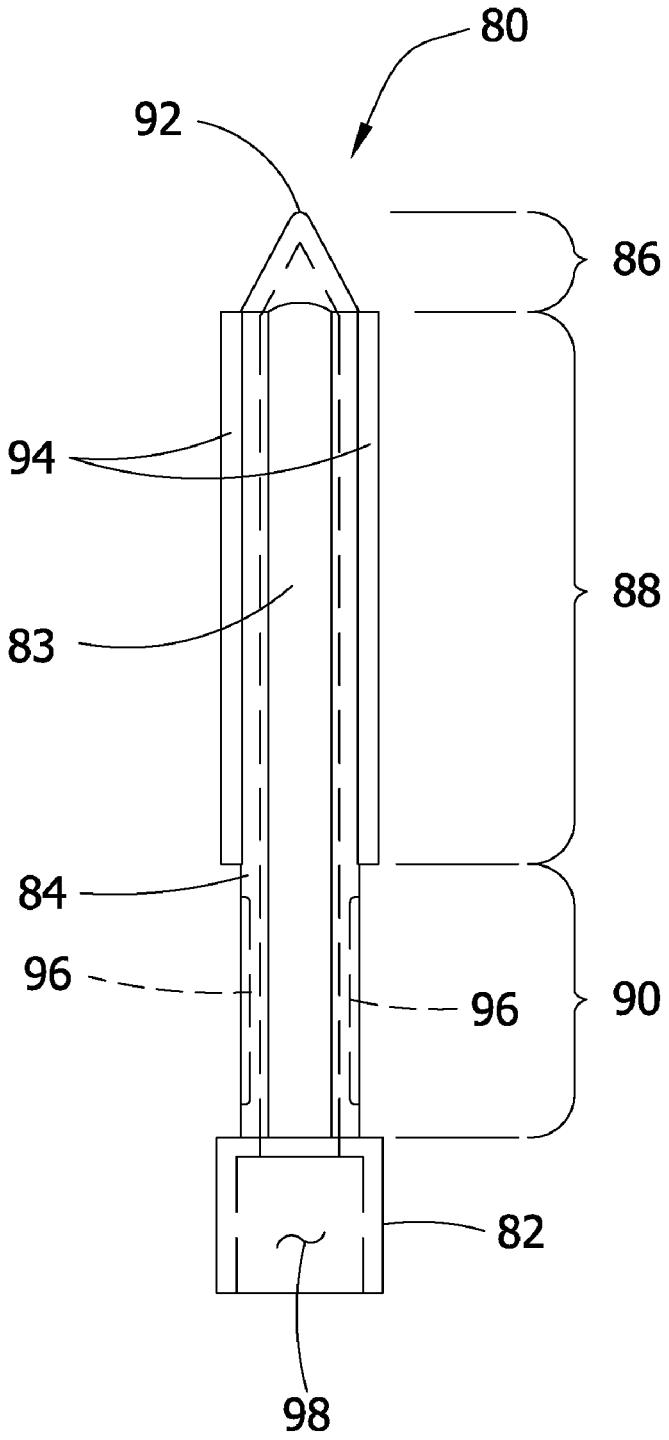
FIG. 30 is a side elevation of one of the stacking posts.

As shown best in FIG. 30, the post 84 of each stacking pin 80 defines longitudinal segments including a top segment 86 distal from the base 82, an intermediate segment 88 and a bottom segment 90 adjacent the base. The top segment 86 has a conical shape with a reduced diameter tip 92. The intermediate segment 88 has a pair of elongate ribs 94 projecting radially outward and running along the length of the intermediate segment. The ribs 94 are suitably sized and shaped in cross-section to correspond to the slots 76 formed in the sleeve 72. Flats 83 are provided on opposite sides of the post 84, e.g., between the ribs 94, to allow the intermediate segment of the post to pass by the nubs 78 upon insertion of the stacking pin 80 through the sleeve 72. The bottom segment 90 of each post 84 is free of the ribs 94 and has a groove 96 extending circumferentially about a portion of the circumference of the bottom segment.

Referring particularly to FIGS. 25-29, to stack drying rack assemblies 70 of this embodiment to form a drying rack system, each stacking pin 80 is inserted into one end of the respective sleeve 72 of one drying rack assembly, depending on the desired configuration (i.e., draining or collecting configuration) of the drying rack assembly. The conical top portion 86 of the post 84 of each stacking pin 80 guides the post into the sleeve 72. The stacking pins 80 are rotated to align the ribs 94 with the slots 76 formed in the sleeve 72 and the pin is pushed further through the sleeve until the ribs exit the opposite open end of the sleeve and the bottom segment 90 of the post 84 is disposed within the sleeve with the nub 78 positioned adjacent the groove 96 along the flats 83 formed in the bottom segment. The stacking pin 80 is then rotated on its axis in either direction (e.g., clockwise or counter-clockwise). As the post 84 rotates relative to the nub 78, the outer diameter of the post compresses the nub to allow further rotation of the post until the nub 78 drops into the groove 96, at which orientation the ribs 94 of the intermediate segment 88 of the post are out of alignment with the slots 76 formed in the sleeve 72. In this manner, the stacking pin 80 is effectively "locked" in place.

To stack a second drying rack assembly 70 on the stacking pins 80, the sleeves 72 of the second drying rack are aligned over the top segments 86 of the stacking pin posts 84 and then the drying rack assembly is lowered onto the stacking pins.

The ribs 94 extending from the intermediate segment 88 of each post 84 (which are now not aligned with the slots 76 in the sleeves 72 of the second drying rack assembly 70) position the second drying rack assembly on the stacking pins 80 and support the second drying rack assembly.

In this embodiment, the drying rack assemblies 70 may be stacked with each drying rack assembly in the draining configuration, or with each assembly in its collecting configuration, or with one assembly in its draining configuration and the other assembly in its collecting configuration.

To mount a third drying rack assembly 70 on top of the second drying rack assembly, another set of stacking pins 80 may be inserted into the sleeves 72 of the second drying rack assembly before the second drying rack assembly is seated on the stacking pins of the first drying rack assembly. The bases 82 of the stacking pins 80 may suitably have cavities 98 (FIG. 30) sized and shaped for receiving the top segments 86 of the stacking pins of the first drying rack assembly 70. Thus, the top segments 86 of the posts 84 of the first drying rack assembly 70 would be received in the cavities 98 of the stacking pins 80 of the second drying rack assembly to support the second drying rack assembly above the first one, and the third drying rack assembly would seat on the top segments of the stacking pins of the second drying rack assembly.

Figure 31:
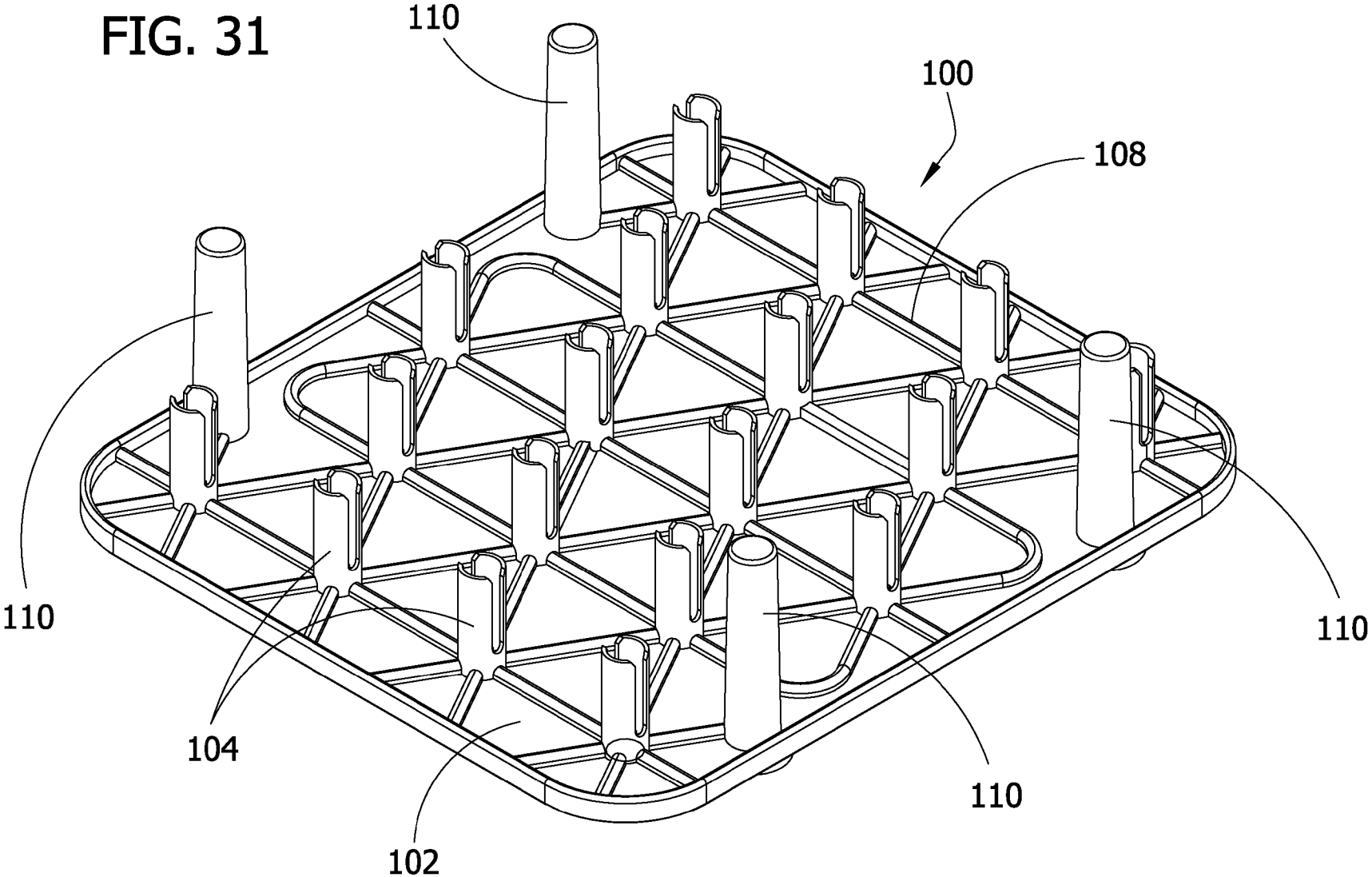
FIG. 31 is a perspective view of a third embodiment of drying rack assembly.
Figure 32:
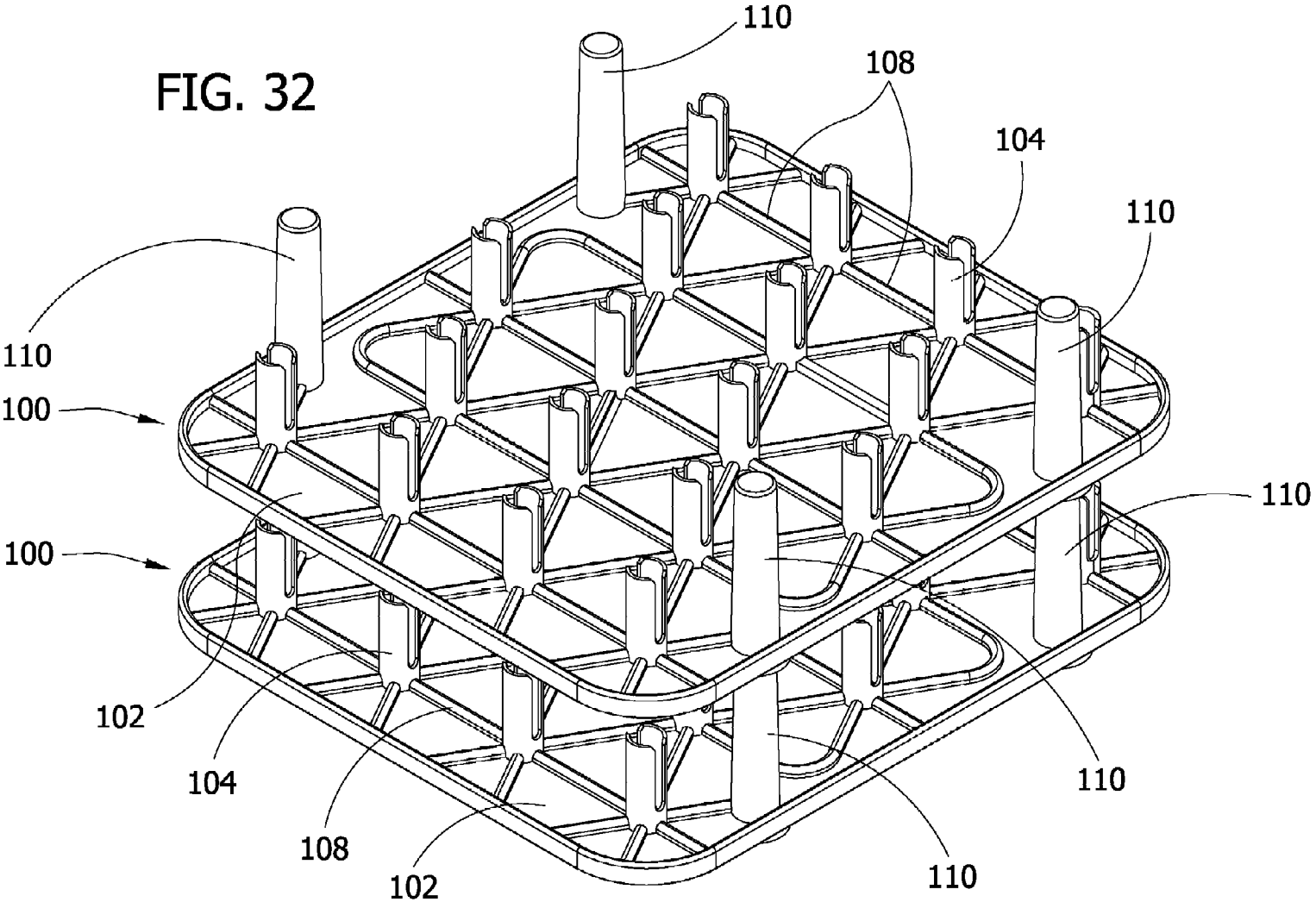
FIG. 32 is a perspective view of a drying rack system in which one drying rack assembly of the third embodiment is stacked upon a second drying rack assembly of the third embodiment.

With reference now to FIGS. 31 and 32, in yet another embodiment a drying rack assembly, generally indicated at 100, is of a one-piece construction comprising a solid panel 102 having a support surface for supporting various bottle components thereon, and a plurality of support posts 104 extending up from the support surface to hold various bottle components. The support posts 104 may be suitably constructed and function in substantially the same manner as the support posts 28 of the previous embodiments. In addition, a pair of opposing slots 106 are formed in each support post 104 and extend longitudinally from the top of the support post generally adjacent the bottom (e.g., adjacent the support surface of the panel 102). The bottom of each post 104 is closed above panel 102, e.g., at the bottom of the slots 106 so that water drains out from the post at the slots. The bottom of the post may be flat, conical or split into two angled planes to facilitate the draining of water from the post via the slots 106. The slots 106 formed in each post 104 thus allow liquid runoff to flow out of the support post and onto the support surface of the panel 102. Ribs 108 are formed on the support surface and intersect at each support post 104 to reduce the contact between the various bottle components and the support surface (e.g., to reduce the risk that the bottle components will contact liquid that is pooled on the support surface of the panel 102).

Tubular stacking posts 110 project upward from the support surface of the panel 102 further than the support posts 104 extend. The cross-sectional dimension of each stacking post 110 tapers inward as the post extends from the support surface upward. Accordingly, as shown in FIG. 32, multiple drying rack assemblies 100 are stackable one upon another by inserting the stacking posts 110 of one drying rack assembly into the internal passage of the stacking posts of another drying rack assembly. Additional ribs (not shown) in the internal passage of the stacking posts 110 limit the insertion distance.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above constructions and products without departing from the scope of the invention, it is intended that all matter contained in the above description and shown in the accompanying drawings and photographs shall be interpreted as illustrative and not in a limiting sense.

What is claimed is:

1. A drying rack assembly for use in air-drying baby bottle components after washing thereof, said drying rack assembly comprising:

a drying rack having a support surface for supporting one or more baby bottle components, the support surface being porous to permit liquid that drains from the bottle components to pass through the support surface; and a one-piece drip pan constructed to at least in part support the drying rack to catch liquid that passes through the support surface, the drip pan being rotatable between a draining configuration in which liquid caught by the drip pan drains out of the drip pan and a collecting configuration in which liquid caught by the drip pan remains within the drip pan.

2. The drying rack assembly of claim 1, wherein the drip pan comprises a non-porous panel onto which liquid passing through the support surface of drying rack contacts in each of the collecting configuration and the draining configuration of the drip pan, the drip pan extending at an angle relative to the drying rack in at least the draining configuration of the drip pan.

3. The drying rack assembly of claim 2, wherein the drip pan extends at an angle relative to the drying rack in each of the collecting configuration and the draining configuration of the drip pan.

4. The drying rack assembly of claim 2, wherein the drying rack is supported by the drip pan in a generally horizontal orientation.

5. The drying rack assembly of claim 2, wherein said drip pan further comprises a peripheral wall extending about and supporting said panel, the peripheral wall of said drip pan extending above and below said panel when said drip pan is in both said draining configuration and said collecting configuration.

6. The drying rack assembly of claim 5, wherein said peripheral wall has an elongate cut-out formed therein extending at least partially along the length of a side of said peripheral wall, said cutout being formed above said panel such that in the draining configuration of the drip pan liquid drains off the panel through the cut-out in the peripheral wall.

7. The drying rack assembly of claim 5, wherein said drying rack has an elongated, generally L-shaped inverted flange connected to a front portion thereof and configured to fit over the peripheral wall of said drip pan to generally secure the drying rack on the drip pan.

8. The drying rack assembly of claim 2, wherein the drying rack is sized smaller than the drip pan so that the drying rack is configurable in a storage configuration in which the drying rack lies on the drip pan generally at said angle of the drip pan.

9. The drying rack assembly of claim 1, wherein said drying rack comprises a first set of support members extending in generally parallel spaced relationship with each other in a first direction, and a second set of support members extending in generally parallel spaced relationship with each other in a second direction different from said first direction such that the second set of support members intersects the first set of support members.

10. The drying rack assembly of claim 1, further comprising a plurality of support posts extending upward from said support surface to support baby bottle components on the support surface of the drying rack.

11. The drying rack assembly of claim 10, wherein said support posts are tubular with open upper and lower ends so as to define central passages therethrough.

12. The drying rack assembly of claim 11, wherein the upper end of each support post has a notch formed therein to define at least one peak on the upper end of the support post.

13. The drying rack assembly of claim 1, wherein said drip pan comprises a plurality of leg extensions configured to support the drying rack assembly above a supporting surface.

14. The drying rack assembly of claim 1, wherein said drip pan has a plurality of sleeves formed in a peripheral wall thereof, said drying rack assembly further comprising a plurality of stacking pins which extend through said sleeves and extend above and below said peripheral wall to permit the stacking of two or more drying rack assemblies.

15. The drying rack assembly of claim 14, wherein said sleeves and said stacking pins are mutually configured such that said stacking pins can be locked in position in said sleeves by rotating said stacking pins relative to said sleeves.

16. The drying rack assembly of claim 1, wherein the one-piece drip pan is invertible between the draining configuration and the collecting configuration.

* * * * *